US006626395B1

(12) United States Patent
Newman et al.

(10) Patent No.: US 6,626,395 B1
(45) Date of Patent: Sep. 30, 2003

(54) DISPENSER FOR PREMOISTENED WIPES

(75) Inventors: William R. Newman, Neenah, WI (US); Herb F. Velazquez, Neenah, WI (US); Ligia A. Rivera, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/545,995

(22) Filed: Apr. 10, 2000

Related U.S. Application Data

(60) Provisional application No. 60/132,024, filed on Apr. 30, 1999.

(51) Int. Cl.[7] ..... B65H 16/06
(52) U.S. Cl. ..... 242/598.6
(58) Field of Search ..... 242/598, 598.3, 242/598.5, 598.6, 590

(56) References Cited

U.S. PATENT DOCUMENTS

| | | | |
|---|---|---|---|
| 1,664,392 | A | 4/1928 | Baruch |
| 2,440,974 | A | 5/1948 | Resch |
| 3,310,353 | A | 3/1967 | Cordis |
| 3,368,522 | A | 2/1968 | Cordis |
| 3,532,210 | A | 10/1970 | Minion et al. |
| 3,568,635 | A | 3/1971 | Poitras et al. |
| 3,592,161 | A | 7/1971 | Hoffmann |
| 3,603,519 | A | 9/1971 | Brown |
| 3,633,838 | A | 1/1972 | Krueger |
| 3,656,699 | A | 4/1972 | Schnyder et al. |
| 3,713,170 | A | 1/1973 | Kaufman |
| 3,729,145 | A | 4/1973 | Koo et al. |
| 3,754,804 | A | 8/1973 | Cushman |
| 3,756,483 | A | 9/1973 | Schraeder |
| 3,771,739 | A | 11/1973 | Nelson |
| 3,775,801 | A | 12/1973 | Walker |
| 3,780,908 | A | 12/1973 | Fitzpatrick et al. |
| 3,784,055 | A | 1/1974 | Anderson |
| 3,788,573 | A | 1/1974 | Thomson et al. |
| 3,795,355 | A | 3/1974 | Gerstein |

(List continued on next page.)

FOREIGN PATENT DOCUMENTS

| | | | | |
|---|---|---|---|---|
| DE | 3840937 C1 | * | 4/1990 | ..... 242/598.6 |
| EP | 0 122 809 A1 | | 10/1984 | |
| EP | 0 251 103 A1 | | 1/1988 | |
| EP | 287545 | * | 10/1988 | ..... 242/598.6 |
| EP | 0 501 905 A1 | | 9/1992 | |
| EP | 0 608 460 A1 | | 8/1994 | |
| EP | 0 608 460 B1 | | 9/1998 | |
| EP | 1 023 863 A1 | | 8/2000 | |
| EP | 1 048 257 A2 | | 11/2000 | |
| EP | 1 048 257 A3 | | 11/2000 | |

(List continued on next page.)

OTHER PUBLICATIONS

Invitation to Pay Additional Fees for Patent Cooperation Treaty application No. PCT/US 01/27698, Date of Mailing Jan. 10, 2002, 7 pages.
Search Report for Patent Cooperation Treaty application No. PCT/US 01/28520, Date of Mailing Mar. 4, 2002, 7 pages.

(List continued on next page.)

*Primary Examiner*—Emmanuel Marcelo
(74) *Attorney, Agent, or Firm*—Brinks Hofer Gilson & Lione

(57) ABSTRACT

A compact dispenser for both premoistened wipes and dry bathroom tissue. The dispenser includes a first compartment for the premoistened wipes. The premoistened wipes may be placed in a removable tray in the first compartment. The dry bathroom tissue may be supported on a roll bar and be partially positioned in a second compartment of the dispenser. The dispenser may be mounted to a conventional bathroom tissue fixture using a mounting device.

24 Claims, 26 Drawing Sheets

U.S. PATENT DOCUMENTS

| | | | |
|---|---|---|---|
| 3,806,055 A | 4/1974 | Bauman | |
| 3,824,953 A | 7/1974 | Boone | |
| 3,836,044 A | 9/1974 | Tilp et al. | |
| 3,836,045 A | 9/1974 | Duhy et al. | |
| 3,837,595 A | 9/1974 | Boone | |
| 3,841,466 A | 10/1974 | Hoffman et al. | |
| 3,843,017 A | 10/1974 | Harrison | |
| 3,848,822 A | 11/1974 | Boone | |
| 3,865,271 A | 2/1975 | Gold | |
| 3,890,622 A | 6/1975 | Alden | |
| 3,913,522 A | 10/1975 | Light | |
| 3,943,859 A | 3/1976 | Boone | |
| 3,949,947 A | 4/1976 | Youngquist et al. | |
| 3,967,756 A | 7/1976 | Barish | |
| 3,970,215 A | 7/1976 | McLaren et al. | |
| 3,982,659 A | 9/1976 | Ross | |
| 3,986,479 A | 10/1976 | Bonk | |
| 3,994,417 A | 11/1976 | Boedecker | |
| 3,995,582 A | 12/1976 | Douglas | |
| 4,002,264 A | 1/1977 | Marchesani | |
| 4,004,687 A | 1/1977 | Boone | |
| 4,025,004 A | 5/1977 | Massey | |
| 4,043,519 A | 8/1977 | Suzuki et al. | |
| 4,069,789 A | 1/1978 | Fukagawa et al. | |
| 4,071,200 A | 1/1978 | Stone | |
| 4,098,469 A | 7/1978 | McCarthy | |
| 4,101,026 A | 7/1978 | Bonk | |
| 4,106,433 A | 8/1978 | Fernando et al. | |
| 4,106,616 A | 8/1978 | Boone | |
| 4,106,617 A | 8/1978 | Boone | |
| 4,114,824 A | 9/1978 | Danielak | |
| 4,124,259 A | 11/1978 | Harris | |
| 4,131,195 A | 12/1978 | Worrell, Sr. | |
| 4,135,199 A | 1/1979 | Kurland et al. | |
| 4,135,678 A | 1/1979 | Williams | |
| 4,138,034 A | 2/1979 | McCarthy | |
| 4,179,078 A | 12/1979 | Mansfield | |
| 4,191,317 A | 3/1980 | Harkins | |
| 4,205,802 A | 6/1980 | Economakis | |
| 4,219,129 A | 8/1980 | Sedwick | |
| 4,222,621 A | 9/1980 | Greenlee et al. | |
| 4,235,333 A | 11/1980 | Boone | |
| 4,244,493 A | 1/1981 | Harrison | |
| 4,260,117 A | 4/1981 | Perrin et al. | |
| 4,274,573 A | 6/1981 | Finkelstein | |
| 4,294,389 A | 10/1981 | Falk et al. | |
| 4,328,907 A | 5/1982 | Beard | |
| 4,353,480 A | 10/1982 | McFadyen | |
| 4,363,454 A | 12/1982 | Mohar | |
| 4,375,874 A | 3/1983 | Leotta et al. | |
| 4,383,656 A | 5/1983 | Campbell | |
| 4,401,248 A | 8/1983 | Helms | |
| 4,411,374 A | 10/1983 | Hotchkiss | |
| 4,425,012 A | 1/1984 | Kley | |
| 4,427,159 A | 1/1984 | Miller et al. | |
| 4,428,497 A | 1/1984 | Julius et al. | |
| 4,432,504 A | 2/1984 | Pace | |
| 4,436,221 A | 3/1984 | Margulies | |
| 4,447,015 A | 5/1984 | Peterson | |
| 4,453,634 A | 6/1984 | Blumenthal | |
| 4,463,912 A | 8/1984 | Grunerud | |
| 4,467,974 A | 8/1984 | Crim | |
| 4,526,291 A | 7/1985 | Margulies | |
| 4,535,912 A | 8/1985 | Bonk | |
| 4,550,855 A | 11/1985 | Harrison | |
| 4,564,148 A | 1/1986 | Wentworth | |
| 4,566,606 A | 1/1986 | Kling | |
| 4,570,820 A | 2/1986 | Murphy | |
| 4,601,938 A | 7/1986 | Deacon et al. | |
| 4,607,809 A | 8/1986 | Sineni et al. | |
| 4,648,530 A | 3/1987 | Granger | |
| 4,659,028 A | 4/1987 | Wren | |
| 4,662,576 A | 5/1987 | Paul | |
| 4,662,577 A | 5/1987 | Lewis | |
| 4,667,890 A | 5/1987 | Gietman, Jr. | |
| 4,684,075 A | 8/1987 | Francis | |
| 4,690,345 A | 9/1987 | Cotey | |
| 4,721,264 A | 1/1988 | Muscarello | |
| 4,735,317 A | 4/1988 | Sussman et al. | |
| 4,756,485 A | 7/1988 | Bastian et al. | |
| 4,775,109 A | 10/1988 | Tegg | |
| 4,784,290 A | 11/1988 | Howard | |
| 4,790,490 A | 12/1988 | Chakravorty | |
| 4,807,823 A | 2/1989 | Wyant | |
| 4,826,063 A | 5/1989 | Ban | |
| 4,828,193 A | 5/1989 | Galbraith | |
| 4,830,301 A | 5/1989 | Miller | |
| 4,834,316 A | 5/1989 | DeLorean | |
| 4,836,368 A | 6/1989 | Cotton | |
| 4,836,462 A | 6/1989 | Bruss | |
| 4,846,412 A | 7/1989 | Morand | |
| 4,860,893 A | 8/1989 | Kaufman | |
| D303,890 S | 10/1989 | Pilot | |
| 4,877,133 A | 10/1989 | Klenter et al. | |
| 4,883,197 A | 11/1989 | Sanchez et al. | |
| 4,884,690 A | 12/1989 | Klenter et al. | |
| 4,890,205 A | 12/1989 | Shaffer | |
| 4,913,365 A | 4/1990 | Shamass | |
| 4,936,452 A | 6/1990 | Pauley | |
| D311,106 S | 10/1990 | Jaber | |
| 4,978,095 A | 12/1990 | Phillips | |
| 4,984,530 A | 1/1991 | Dutton | |
| 4,989,800 A | 2/1991 | Tritch | |
| 4,991,538 A | 2/1991 | Davids et al. | |
| 5,000,393 A | 3/1991 | Madsen | |
| 5,009,313 A | 4/1991 | Morand | |
| 5,012,986 A | 5/1991 | Needle | |
| 5,029,787 A | 7/1991 | Florentin | |
| 5,049,440 A | 9/1991 | Bornhoeft, III et al. | |
| 5,050,737 A | 9/1991 | Joslyn et al. | |
| 5,104,054 A | 4/1992 | Latham | |
| 5,137,173 A | 8/1992 | Hughes et al. | |
| 5,141,171 A | 8/1992 | Yang | |
| 5,145,091 A | 9/1992 | Meyers | |
| D329,978 S | 10/1992 | Ryan | |
| 5,154,496 A | 10/1992 | Campbell et al. | |
| 5,170,958 A | 12/1992 | Brown | |
| 5,172,840 A | 12/1992 | Bloch et al. | |
| 5,192,044 A | 3/1993 | Baskin | |
| 5,193,759 A | 3/1993 | Bigelow et al. | |
| 5,195,689 A | 3/1993 | Beer et al. | |
| 5,207,367 A | 5/1993 | Dunn et al. | |
| 5,219,092 A | 6/1993 | Morand | |
| 5,228,632 A | 7/1993 | Addison et al. | |
| 5,253,818 A | 10/1993 | Craddock | |
| 5,255,800 A | 10/1993 | Kelly | |
| D342,635 S | 12/1993 | Carter et al. | |
| D342,852 S | 1/1994 | Welch | |
| 5,277,375 A | 1/1994 | Dearwester | |
| 5,310,262 A | 5/1994 | Robison et al. | |
| 5,311,986 A * | 5/1994 | Putz | 242/598.5 |
| 5,312,883 A | 5/1994 | Komatsu et al. | |
| 5,317,063 A | 5/1994 | Komatsu et al. | |
| D347,534 S | 6/1994 | Gottselig | |
| 5,335,811 A | 8/1994 | Morand | |
| 5,368,157 A | 11/1994 | Gasparrini et al. | |
| 5,370,336 A | 12/1994 | Whittington | |
| 5,374,008 A | 12/1994 | Halvorson et al. | |
| 5,384,189 A | 1/1995 | Kuroda et al. | |
| 5,392,945 A | 2/1995 | Syrek | |
| 5,400,982 A | 3/1995 | Collins | |

| | | | |
|---|---|---|---|
| 5,409,181 | A | 4/1995 | Patrick |
| 5,439,521 | A | 8/1995 | Rao |
| 5,443,084 | A | 8/1995 | Saleur |
| 5,449,127 | A | 9/1995 | Davis |
| D362,773 | S | 10/1995 | Kartchner |
| 5,456,420 | A | 10/1995 | Frazier |
| 5,456,421 | A | 10/1995 | Reed |
| 5,462,197 | A | 10/1995 | Pound |
| 5,464,096 | A | 11/1995 | Hurwitz |
| 5,464,170 | A | 11/1995 | Mitchell et al. |
| 5,480,060 | A | 1/1996 | Blythe |
| 5,494,250 | A | 2/1996 | Chen |
| 5,495,997 | A | 3/1996 | Moody |
| 5,501,323 | A | 3/1996 | Denesha et al. |
| 5,509,593 | A | 4/1996 | Bloch et al. |
| 5,520,308 | A | 5/1996 | Berg, Jr. et al. |
| 5,526,973 | A | 6/1996 | Boone et al. |
| 5,533,621 | A | 7/1996 | Schoal, Jr. |
| 5,540,332 | A | 7/1996 | Kopacz et al. |
| 5,542,568 | A | 8/1996 | Julius |
| 5,560,514 | A | 10/1996 | Frazier |
| 5,588,615 | A | 12/1996 | Batts |
| D377,284 | S | 1/1997 | Farrow et al. |
| 5,598,987 | A | 2/1997 | Wachowicz |
| 5,604,992 | A | 2/1997 | Robinson |
| 5,605,250 | A | 2/1997 | Meiron et al. |
| 5,609,269 | A | 3/1997 | Behnke et al. |
| 5,618,008 | A | 4/1997 | Dearwester et al. |
| 5,620,148 | A | 4/1997 | Mitchell |
| 5,624,025 | A | 4/1997 | Hixon |
| 5,630,526 | A | 5/1997 | Moody |
| 5,630,563 | A | 5/1997 | Meisner et al. |
| 5,631,317 | A | 5/1997 | Komatsu et al. |
| 5,642,810 | A | 7/1997 | Warner et al. |
| 5,649,676 | A | 7/1997 | Lord |
| D381,851 | S | 8/1997 | Sharpe |
| 5,653,403 | A | 8/1997 | Ritchey |
| 5,655,661 | A | 8/1997 | Rigby |
| 5,660,313 | A | 8/1997 | Newbold |
| 5,660,636 | A | 8/1997 | Shangold et al. |
| 5,667,092 | A | 9/1997 | Julius et al. |
| 5,669,576 | A | 9/1997 | Moody |
| 5,672,206 | A | 9/1997 | Gorman |
| D386,025 | S | 11/1997 | Mervar et al. |
| 5,687,875 | A | 11/1997 | Watts et al. |
| D387,590 | S | 12/1997 | Cameron et al. |
| 5,697,576 | A | 12/1997 | Bloch et al. |
| 5,697,577 | A | 12/1997 | Ogden |
| 5,704,565 | A | 1/1998 | Cheng |
| 5,704,566 | A | 1/1998 | Schutz et al. |
| 5,765,717 | A | 6/1998 | Gottselig |
| D397,265 | S | 8/1998 | Badillo |
| RE35,976 | E | 12/1998 | Gasparrini et al. |
| 5,848,762 | A | 12/1998 | Reinheimer et al. |
| 5,868,275 | A | 2/1999 | Moody |
| 5,868,335 | A | 2/1999 | Lebrun |
| 5,868,344 | A | 2/1999 | Melnick |
| 5,868,345 | A | 2/1999 | Beisser |
| 5,868,346 | A | 2/1999 | Cobos |
| 5,868,347 | A | 2/1999 | Paul et al. |
| 5,875,985 | A | 3/1999 | Cohen et al. |
| 5,887,759 | A | 3/1999 | Ayigbe |
| 5,887,818 | A | 3/1999 | Kelley |
| 5,893,531 | A | 4/1999 | Taylor et al. |
| 5,897,074 | A | 4/1999 | Marino |
| 5,901,921 | A | 5/1999 | Perlsweig |
| 5,904,316 | A | 5/1999 | Dunning et al. |
| 5,914,177 | A | 6/1999 | Smith, III et al. |
| 5,924,617 | A | 7/1999 | LaCount et al. |
| D412,439 | S | 8/1999 | Cormack |
| 5,938,013 | A | 8/1999 | Palumbo et al. |
| 5,950,960 | A | 9/1999 | Marino |
| 5,951,762 | A | 9/1999 | Shangold et al. |
| 5,958,187 | A | 9/1999 | Bhat et al. |
| 5,964,351 | A | 10/1999 | Zander |
| 5,967,452 | A | 10/1999 | Wilder |
| 5,971,138 | A | 10/1999 | Soughan |
| 5,971,142 | A | 10/1999 | Jones |
| D416,794 | S | 11/1999 | Cormack |
| D417,109 | S | 11/1999 | Johnson et al. |
| 5,979,821 | A | 11/1999 | LaCount et al. |
| 5,992,718 | A | 11/1999 | Zaranck |
| D417,987 | S | 12/1999 | Velazquez |
| 6,000,538 | A | 12/1999 | Lee |
| 6,000,658 | A | 12/1999 | McCall, Jr. |
| 6,007,019 | A | 12/1999 | Lynch |
| 6,010,001 | A | 1/2000 | Osborn, III |
| 6,015,125 | A | 1/2000 | Fischer |
| 6,024,216 | A | 2/2000 | Shillington et al. |
| 6,024,217 | A | 2/2000 | Ponsi et al. |
| 6,024,323 | A | 2/2000 | Palerno, Jr. |
| D421,691 | S | 3/2000 | Hoblitz |
| 6,036,134 | A | 3/2000 | Moody |
| D422,437 | S | 4/2000 | Conran et al. |
| 6,047,920 | A | 4/2000 | Dearwester et al. |
| 6,056,233 | A | 5/2000 | Von Schenk |
| 6,056,235 | A | 5/2000 | Brozinsky |
| 6,059,882 | A | 5/2000 | Steinhardt et al. |
| 6,059,928 | A | 5/2000 | Van Luu et al. |
| 6,068,118 | A | 5/2000 | Calloway |
| 6,070,821 | A | 6/2000 | Mitchell |
| 6,079,603 | A | 6/2000 | Smegal |
| 6,082,664 | A | 7/2000 | Phelps et al. |
| 6,085,899 | A | 7/2000 | Thorsbakken |
| 6,092,690 | A | 7/2000 | Bitowft et al. |
| 6,092,758 | A | 7/2000 | Gemmell |
| 6,092,759 | A | 7/2000 | Gemmell et al. |
| D429,282 | S | 8/2000 | Velazquez et al. |
| 6,098,836 | A | 8/2000 | Gottselig |
| 6,121,165 | A | 9/2000 | Mackey et al. |
| 6,138,939 | A | 10/2000 | Phelps et al. |
| 6,158,614 | A | 12/2000 | Haines et al. |

FOREIGN PATENT DOCUMENTS

| | | | | |
|---|---|---|---|---|
| GB | 990332 | | 4/1965 | |
| GB | 1324818 | | 7/1973 | |
| GB | 1 327 954 | | 8/1973 | |
| GB | 2 357 076 | A | 6/2001 | |
| JP | 57-170658 | * | 10/1982 | ..... 242/598.3 |
| WO | WO 93/17933 | | 9/1993 | |
| WO | WO 96/21388 | A1 | 7/1996 | |
| WO | WO 97/24054 | | 7/1997 | |
| WO | WO 98/08763 | A1 | 3/1998 | |
| WO | WO 99/06311 | A2 | 2/1999 | |
| WO | WO 99/01536 | A1 | 4/1999 | |
| WO | WO 00/00071 | | 1/2000 | |
| WO | WO 00/08998 | | 2/2000 | |

OTHER PUBLICATIONS

Search Report for Patent Cooperation Treaty application No. PCT/US01/27698, Date of Mailing Apr. 5, 2002, 4 pages.

Derwent World Patent Database abstract of DE 3133237: Description of M. Scheepe, "Refill Pack of Moisture–Impregnated Tissues.".

Derwent World Patent Database abstract of JP 07–284,461 A: Description of Kusunoki N (KUSU–I), "Toilet Paper Holder," and Patent Abstracts of Japan JP 07–284,461: Description of Kusunoki Nobuaki, "Toilet Paper–Holder Allowing Taking Out Paper Thereof With One Hand.".

Derwent World Patent Database abstract of JP 00–085,782 A: Description of Pigeon KK (PIGE–N), "Paper Holder For Wet Tissues Used In Toilets," and Patent Abstracts of Japan JP 00–085,782: Description of Watanabe Kuniko et al., "Paper Holder,".
Kotler, Philip, *Marketing Management,* Prentice Hall, Upper Saddle River, NJ, 2000, p. 456–483.
PCT search report for application serial No.: PCT/US00/11284, dated Jul. 28, 2000.
Images of MOIST MATES product—dispenser and wipes, approximately 1996.
Images of MOIST MATES product—dispenser, approximately 2000.
Images of MOIST MATES product—refill wipes, approximately 2000.
Search Report for Patent Cooperation Treaty application No. PCT/US 01/11195, Date of Mailing Jul. 19, 2001, 7 pages.
Search Report for Patent Cooperation Treaty application No. PCT/US 01/11198, Date of Mailing Jul. 19, 2001, 7 pages.
Search Report for Patent Cooperation Treaty application No. PCT/US 01/11620, Date of Mailing Jul. 19, 2001, 7 pages.
Search Report for Patent Cooperation Treaty application No. PCT/US 01/11686, Date of Mailing Jul. 11, 2001, 5 pages.
Search Report for Patent Cooperation Treaty application No. PCT/US 01/11131, Date of Mailing Jul. 23, 2001, 7 pages.
Search Report for Patent Cooperation Treaty application No. PCT/US 01/11447, Date of Mailing Jul. 19, 2001, 6 pages.
Search Report for Patent Cooperation Treaty application No. PCT/US 01/11467, Date of Mailing Jul. 19, 2001, 7 pages.
Search Report for Patent Cooperation Treaty application No. PCT/US 01/12091, Date of Mailing Jul. 9, 2001, 4 pages.
Search Report for Patent Cooperation Treaty application No. PCT/US 01/14113, Date of Mailing Jul. 19, 2001, 6 pages.
Search Report for Patent Cooperation Treaty application No. PCT/US 01/40677, Date of Mailing Jul. 19, 2001, 6 pages.
Letter, dated Apr. 4, 1998, and accompanying drawings.

* cited by examiner

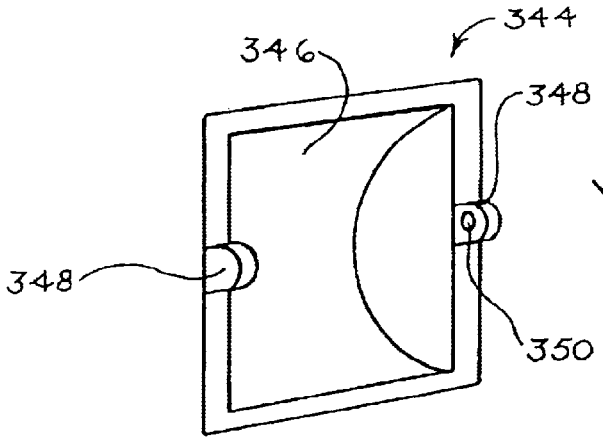
Fig. 34
CONVENTIONAL
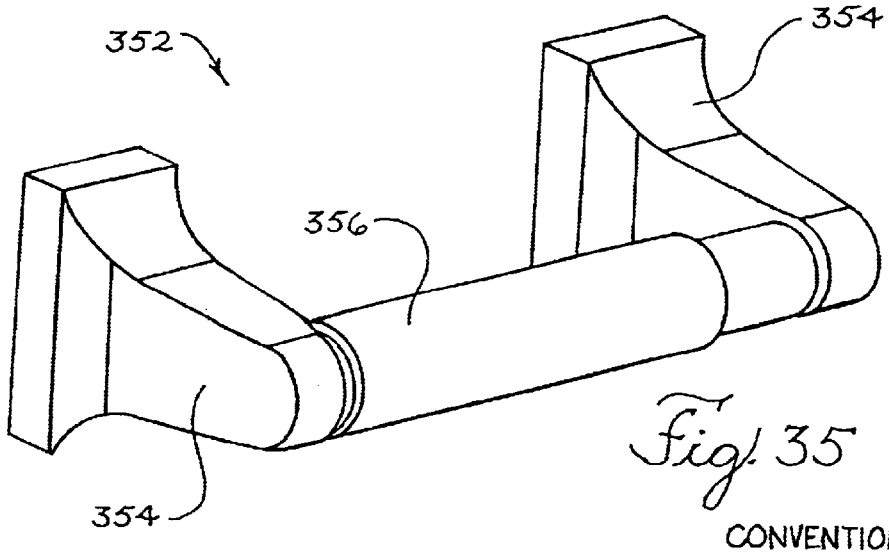
Fig. 35
CONVENTIONAL

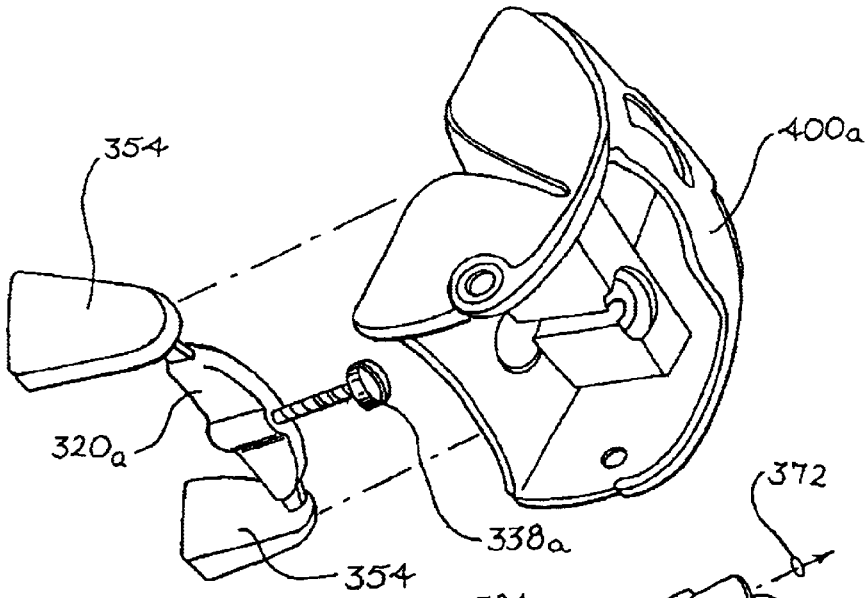
Fig. 42
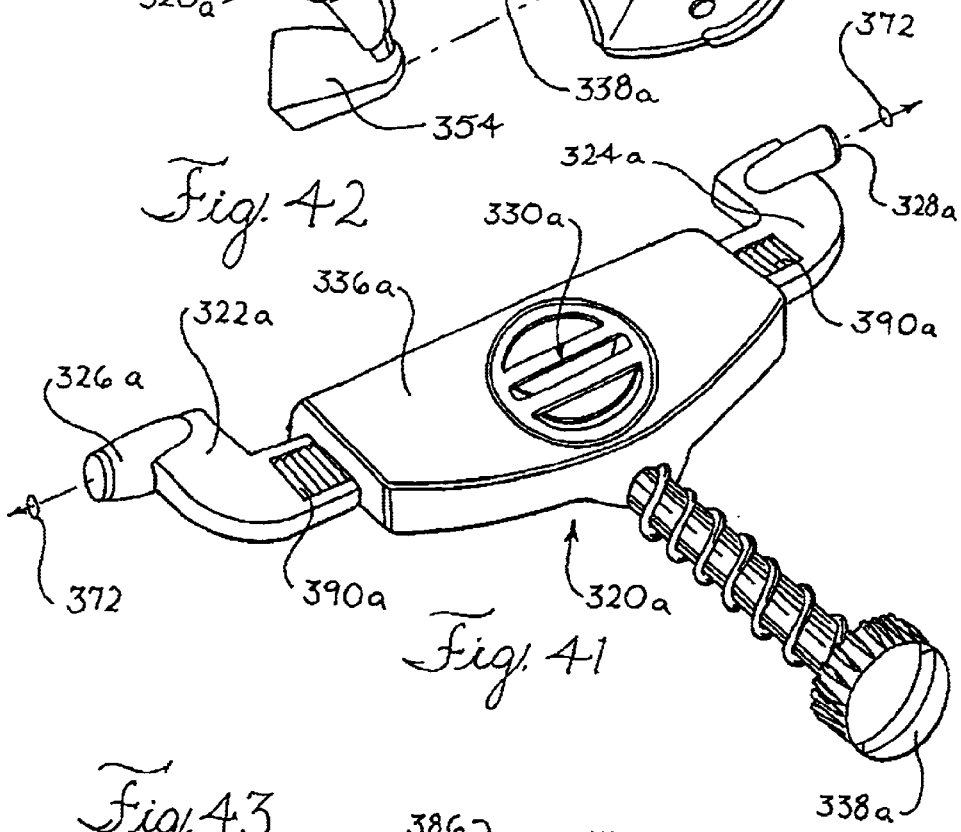
Fig. 41
Fig. 43
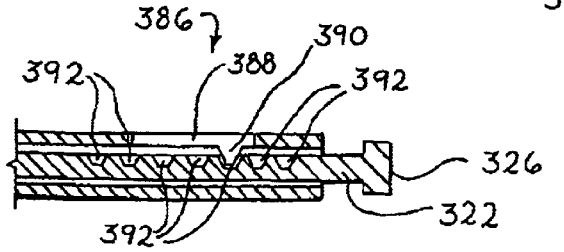

Fig. 52
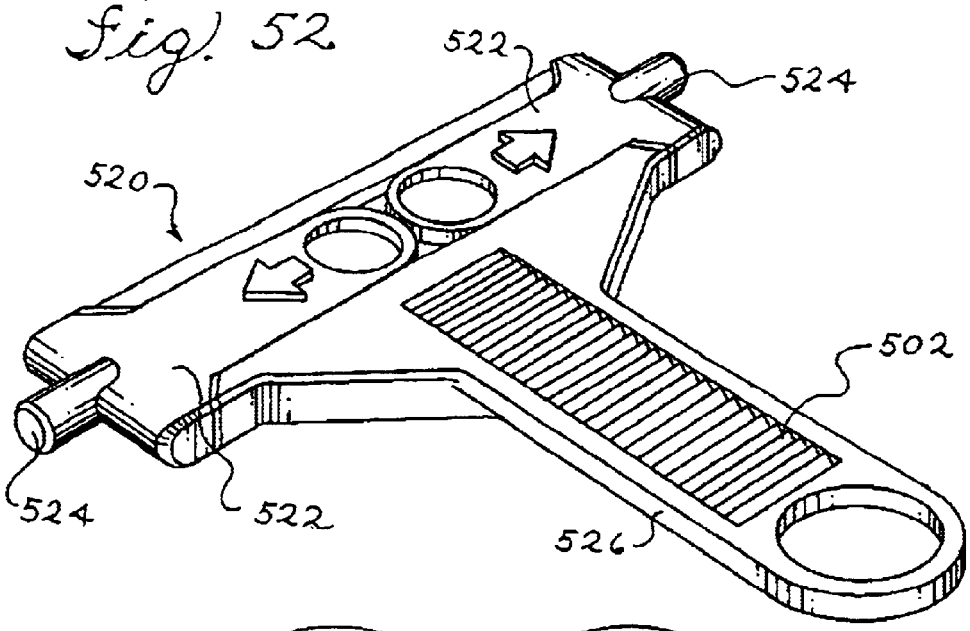
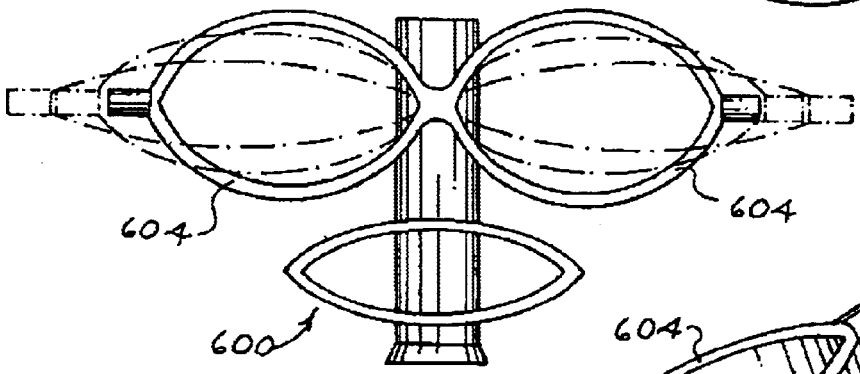
Fig. 51
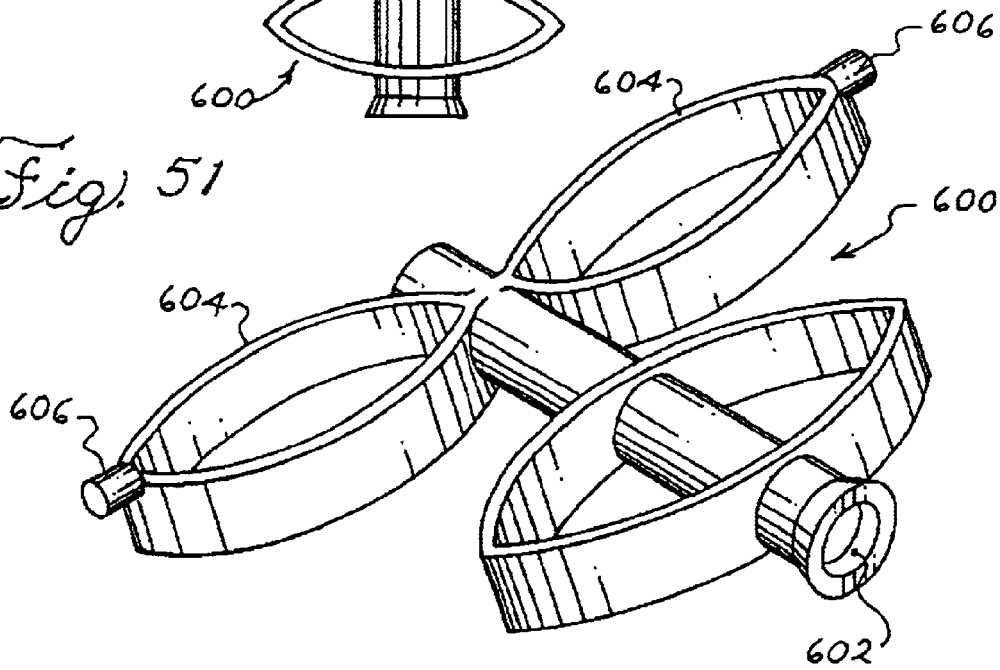
Fig. 50

DISPENSER FOR PREMOISTENED WIPES

This application is a continuation of, and claims the benefit of the filing date pursuant to 35 U.S.C. §119(e) of, Provisional Application Serial No. 60/132,024, filed Apr. 30, 1999, for a dispenser for premoistened wipes, the disclosure of which is hereby incorporated by reference.

BACKGROUND OF THE INVENTION

The present invention relates to dispensers and, more specifically, to a dispenser for both premoistened wipes and dry bathroom tissue.

The use of premoistened wipes is well known. Such premoistened wipes are commonly used with small children and infants when replacing soiled diapers. Premoistened wipes are also used to provide a convenient and effective cleaning material in the absence of running water. Premoistened wipes are also used as a replacement for, or supplement to, dry bathroom tissue.

Premoistened wipes may be supplied in individual packages or supplied in larger quantities. While individually supplied wet wipes are typically provided in disposable packaging, larger quantities of wipes may be supplied in either disposable or re-useable containers. Two common containers for supplying multiple wipes are resealable bags and tubs. The resealable bags often have a "zippered" opening which has a pair of interlocking profiles which may be re-engaged to seal the bag after removing one or more wipes from the bag. Tubs are also common and often have a lid which allows access to a stack of folded wipes when the lid is in an open position.

SUMMARY OF THE INVENTION

The present inventors have recognized difficulties and problems inherent in the prior art and in response thereto have developed an improved dispenser for premoistened wipes and dry bathroom tissue.

In one aspect, the present invention provides a dispenser for premoistened wipes and dry tissue mountable on a conventional bathroom tissue fixture which comprises, i.e., includes but is not limited to, a compact housing having a first compartment, and a second compartment. The first compartment defines a substantially enclosed interior space in which the premoistened wipes may be positioned and the second compartment includes a support bar for dry tissue. The housing may also include at least one substantially horizontal engagement surface. A mounting device which supportingly engages the engagement surface and has a first support and a second support may also be included with the dispenser. The first and second supports define a lateral axis and are projectable outwardly from opposite sides of the dispenser for engagement with the fixture. The mounting device is adjustably attachable to the dispenser whereby the mounting device engages a selective portion of the engagement surface and the lateral axis is selectively positionable relative to the dispenser housing.

A compact dispenser may be provided by placing one compartment above the mounting device and the other compartment below the mounting device. By utilizing compartments which generally define a relatively larger volume nearest the mounting device and define a relatively smaller volume near the upper and lower edges of the dispenser, the compactness of such a dispenser may be enhanced. A generally curvilinear front surface may be used with such a dispenser.

Such a dispenser may have a first compartment which further includes a first horizontally extending panel and a second compartment which includes a second horizontally extending panel, said first and second horizontally extending panels relatively disposed in spaced and substantially parallel positions and defining a slot therebetween for slidably receiving the mounting device. The engagement surface may be located on one of the horizontally extending panels and the slot may have first and second openings on opposite lateral sides of the dispenser through which the first and second supports may project outwardly.

The mounting device may be laterally and slidably engaged with the housing whereby the mounting device is slidable in a direction which is substantially perpendicular to the lateral axis defined by the first and second supports. Such a mounting device may be positioned between the first and second compartments and laterally engage a panel defining a portion of one of said panels.

The mounting device may also be slidably positioned between the first and second horizontally extending panels and laterally engage each of the horizontally extending panels. Such a mounting device may include a first projection for engaging a first recess in the first horizontally extending panel and a second projection for engaging a second recess in the second horizontally extending panel.

The dispenser may also include a tray having a support surface for the premoistened wipes wherein the tray is removably positioned in the interior space of the first compartment. The first compartment may also include a cover having open and closed positions.

In another aspect, the present invention provides a dispenser for premoistened wipes and dry tissue mountable on a conventional bathroom tissue fixture which includes a housing having a first compartment and a second compartment. The first compartment includes a first plurality of connected panels which includes a first horizontally extending panel and wherein the premoistened wipes are positionable within the first compartment. The second compartment includes a second plurality of connected panels which includes a second horizontally extending panel. The second compartment also includes a support bar for the dry tissue wherein the support bar is attachable to at least one of the second plurality of panels. A mounting device is adjustably positioned between the first and second horizontally extending panels and includes first and second supports. The first and second supports define a lateral axis and are projectable outwardly from opposite sides of the dispenser for engagement with the fixture.

In yet another aspect, the present invention provides a dispenser for premoistened wipes and dry tissue which is mountable on a conventional bathroom tissue fixture. The dispenser includes a first compartment having a cover and defining a substantially enclosed interior space. A tray having a support surface for the premoistened wipes is removably positioned within the interior space of the first compartment. A support bar for the dry tissue is attachable to the dispenser. The dispenser also includes a mounting device having first and second supports. The first and second supports define a lateral axis and are projectable outwardly from opposite sides of the dispenser for engagement with the fixture. The mounting device being adjustably positionable relative to the first compartment.

In a still further aspect, the present invention provides a dispenser for premoistened wipes and dry tissue which includes a housing having a first compartment and a second compartment. The first compartment includes a cover panel cooperatively engageable with a first plurality of panels whereby the cover and first plurality of panels define a substantially enclosed interior space when the cover is in a closed position. The premoistened wipes are positionable within the interior space of the first compartment. The second compartment includes a pair of side panels which have a pair of oppositely disposed recesses for supporting a roll bar which may, in turn, support a roll of conventional dry bathroom tissue. The dispenser also includes a pair of pivot arms attached to the cover panel. The pivot arms are pivotally connected to the dispenser whereby the cover panel is moveable between a closed position and an open position. The pivot axis of the pivot arms is aligned with the oppositely disposed recesses for supporting the roll bar.

One advantage provided by the present invention is that it provides a dispenser for both premoistened wipes and dry tissue which may be conveniently attached to a conventional bathroom tissue fixture. Moreover, those embodiments of the present invention which include an adjustably positionable mounting device may be easily mounted to a wide variety of different conventional bathroom tissue fixtures.

Yet another advantage of the present invention is that it provides a compact dispenser capable of dispensing either or both premoistened wipes and conventional dry bathroom tissue. These and other advantages of the invention are provided by its various aspects, individually and in combinations thereof.

BRIEF DESCRIPTION OF THE DRAWINGS

The invention will be more fully understood and further advantages will become apparent when reference is made to the following description of the invention and the accompanying drawings, in which:

FIG. 34 is a perspective view of a conventional bathroom tissue fixture;

FIG. 35 is a perspective view of another conventional bathroom tissue fixture;

FIG. 41 is a view of an alternative mounting device;

FIG. 42 is a perspective view of the mounting device of FIG. 31 attached to a conventional bathroom tissue fixture and a dispenser;

FIG. 43 is a cross sectional view of a latching mechanism;

FIG. 50 is a perspective view of a mounting device;

FIG. 51 is a top view of the mounting device of FIG. 50;

FIG. 52 is a perspective view of a mounting device;

Figure 1:
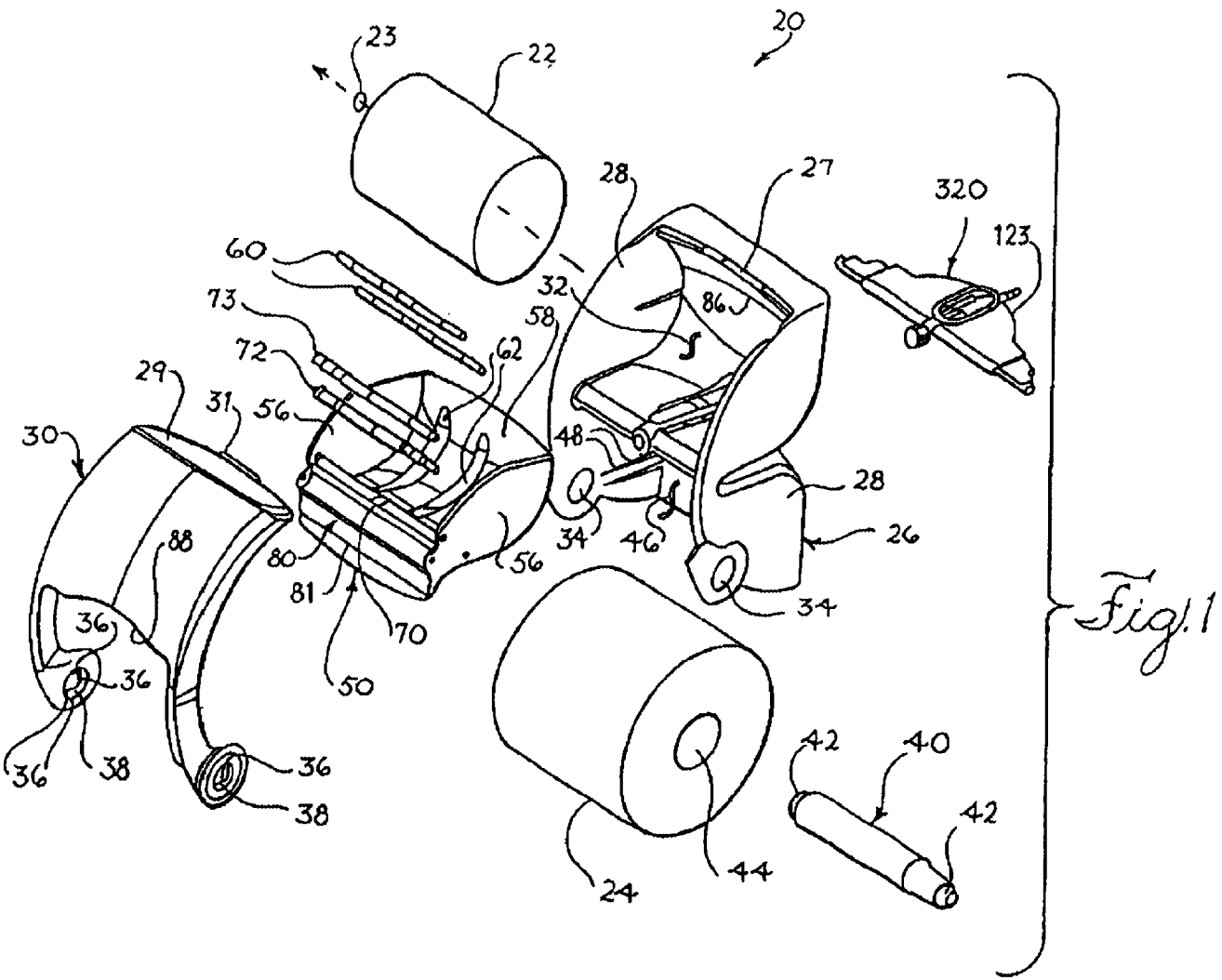
FIG. 1 is an exploded view of a compact dispenser in accordance with the present invention.

Corresponding reference characters indicate corresponding parts throughout the several views. The disclosed embodiments are set forth to illustrate and exemplify the invention. The disclosed embodiments are not intended to be an exhaustive illustration of the invention or to be construed as limiting the scope of the invention to the precise forms disclosed.

DESCRIPTION OF THE INVENTION

Figure 2:
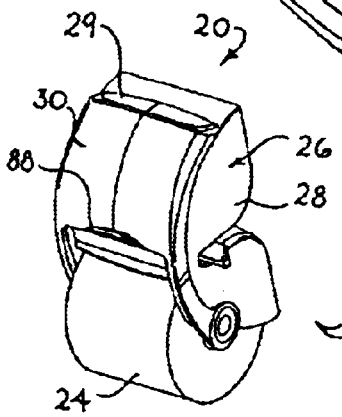
FIG. 2 is a perspective view of the dispenser of FIG. 1.
Figure 3:
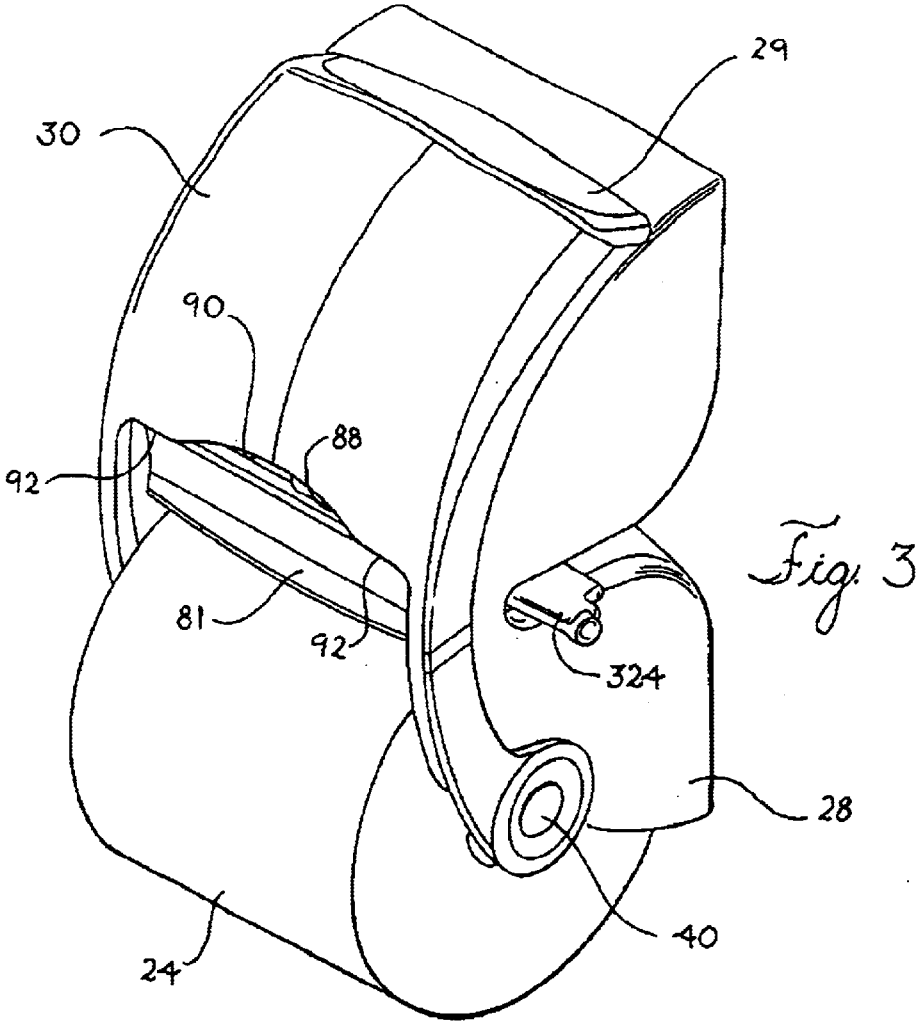
FIG. 3 is a perspective view of an alternative dispenser.
Figure 4:
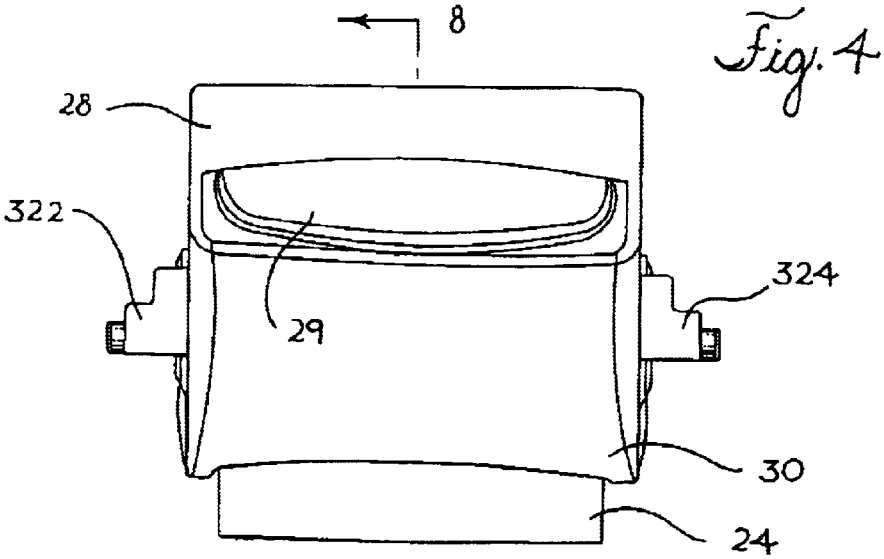
FIG. 4 is a top view of the dispenser of FIG. 3.
Figure 6:
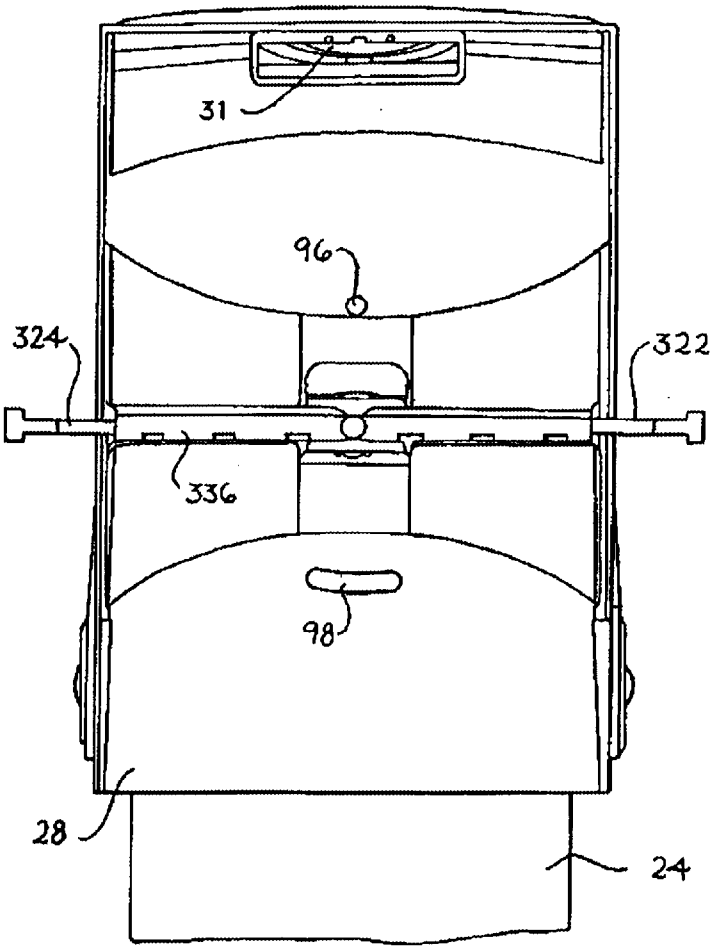
FIG. 6 is a rear view of the dispenser of FIG. 3.
Figure 5:
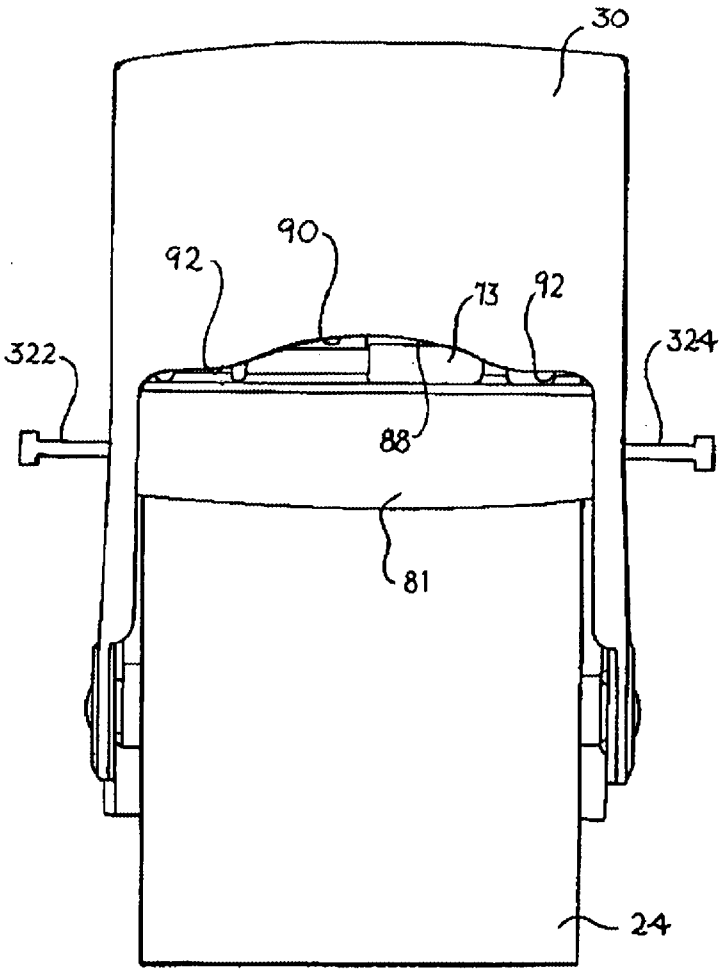
FIG. 5 is a front view of the dispenser of FIG. 3.
Figure 23:
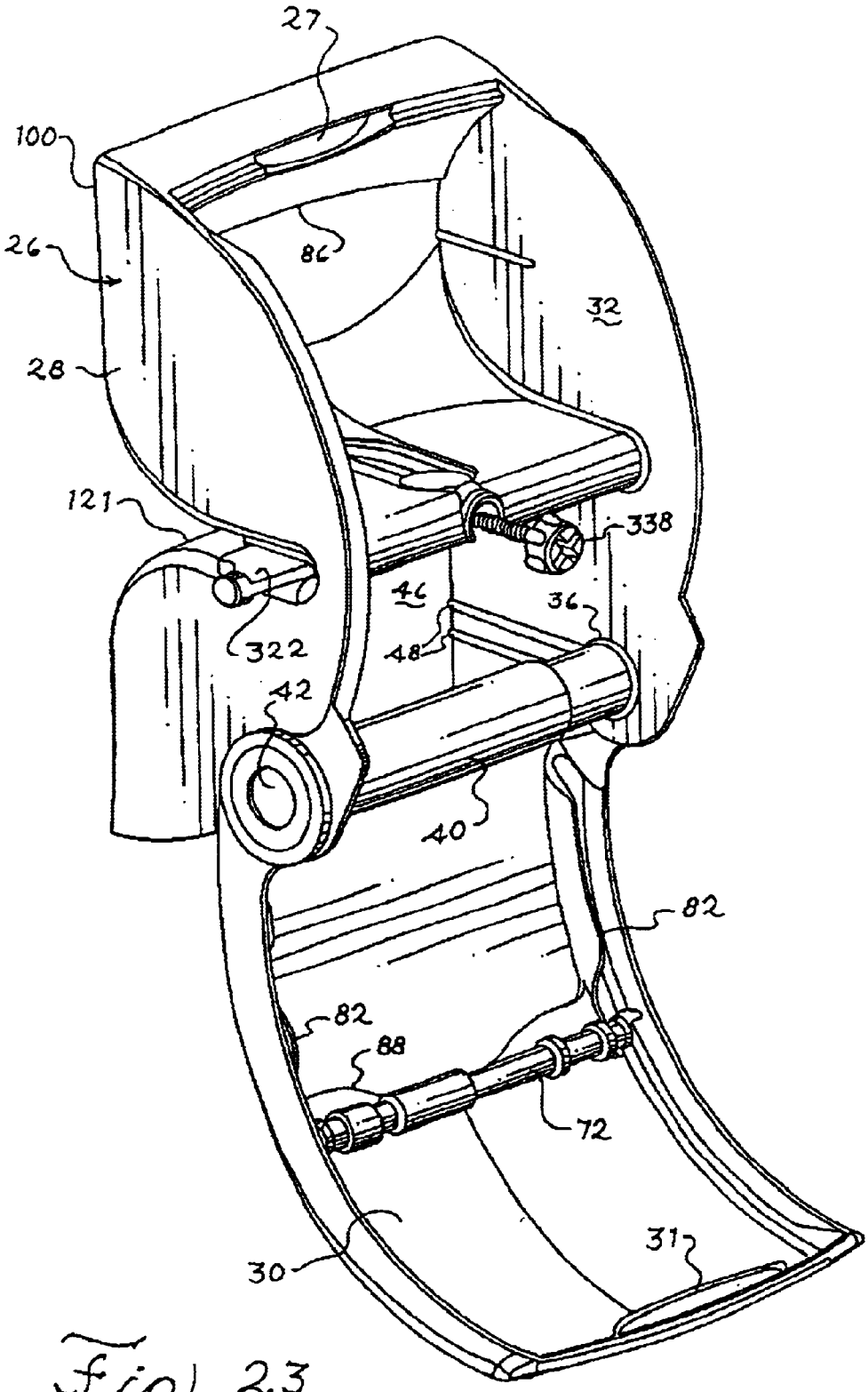
FIG. 23 is a perspective view of a dispenser housing and a mounting device.

FIG. 1 illustrates one representative embodiment of the present invention in an exploded view. As can be seen in FIG. 1, the illustrated dispenser 20 can be used to provide either or both premoistened wipes 22 and conventional dry bathroom tissues 24. The illustrated dispenser has a housing 26 with a frame 28 and a cover 30. Together the frame 28 and cover 30 enclose and define a first compartment having an interior space 32 when the cover is in a closed position as shown in FIG. 2. The cover 30 is shown in an open position in FIGS. 12 and 23.

The cover 30 is attached to the frame 28 at two circular apertures 34 in the frame 28. The cover 30 includes a plurality of projections 36 which are inserted inwardly through the apertures 34 to rotatably mount the cover 30 to the frame 28. The projections 36 provide a bearing surface for engagement with the interior surface of the apertures 34 whereby the cover 30 may be rotated between an open position and a closed position. Some or all of the projections 36 may include outwardly extending tangs at their distal ends which engage the inner surface of the frame 28 adjacent the apertures 34 and thereby inhibit the disengagement of the cover 30 and the frame 28.

The radially inward surfaces 38 of the projections 36 define an opening which is configured to receive the recessed end portions 42 of a telescoping roll bar 40. Telescoping roll bar 40 provides a support which is insertable into the hollow core 44 of a roll of dry bathroom tissue 24 in a conventional manner. The illustrated roll bar 40 has a female member which extends for approximately ¾ of the total length of the support to prevent the bar from tilting. The male and female members of the roll bar 40 remain assembled when removed from the dispenser 20 and include an internal spring selected to have a force which does not distort the housing frame 28. The ends of the roll bar 40 define a curved surface to provide an outward button-like appearance to the ends of the roll bar 40 and facilitate the removal of the roll bar 40. The telescoping members of the roll bar 40 may be advantageously made of the same materials as the frame 28 and have a matching color.

Alternative supports which are insertable into the hollow core 44 of a rolled tissue product 24 and allow the rotation of the rolled tissue 24 thereon, such as alternative telescoping roll bars, a freely extending cylindrical or J-shaped projection, are also well known and may be combined with the housing 26 to provide for the dispensing of a dry rolled tissue product.

The illustrated frame 28 includes a second compartment defining a lower space 46 in which a portion of the dry bathroom tissue 24 is located after the dry tissue 24 is mounted on the roll bar 40. As can be seen in FIG. 1, the frame 28 may also include reinforcing ribs 48 which both provide strength to the frame 28 and help the user of the dispenser 20 to locate the apertures 34 when installing the roll bar 40.

The illustrated cover 30 also includes a recessed portion 29 which allows the cover to be easily grasped when opening the cover 30. Adjacent the recessed portion 29, a latching projection 31 extends from the cover and is received by recess 27 located in the frame 28. The latching projection 31 may engage the recess 27 with an interference or snap fit relationship whereby the engagement of the latching projection 31 with the recess 27 maintains the cover 30 in a closed position. Downward pressure on recessed portion 29 disengages the projection 31 and recess 27 to allow the cover 30 to be opened. The recessed portion 29 may advantageously employ a different surface texture or color adjacent the latching projection 31 to indicate where pressure should be applied to open the cover 30. The illustrated recess 27 is positioned to be generally hidden from view when the cover 30 is in a closed position. A large variety of different methods and mechanisms for retaining a cover to a frame are known and may be substituted for the illustrated latching method.

The cover 30 may be advantageously formed out of material which permits a user of the dispenser to determine the amount of premoistened wipes remaining in the interior space 32 without opening the cover 30. Alternatively, a small portion of the cover 30 may be clear or partially clear to permit an external visual determination of the amount of premoistened wipes 22 which remain in the interior space 32. The cover 30 may be advantageously formed by an injection molding process using a polycarbonate material.

The illustrated dispenser 20 also includes a removable tray 50. The tray 50 includes a liquid retaining receptacle portion 52 which faces upward when the tray is placed within the dispenser 20. When positioned in the dispenser 20, the tray 50 defines the lower boundary of the interior space 32 in which the premoistened wipes 22 are placed. The tray 50 may be removed by merely opening the cover 30 without dismounting the frame 28.

The liquid retaining receptacle portion 52 of the illustrated tray is formed by an impermeable lower surface 54 and several upwardly extending walls which define a volume at the lower portion of the tray 50. The receptacle portion 52 of the tray collects excess solution from the premoistened wipes 22 and thereby prevents the excess solution from soiling or wetting the other components of the dispenser or the dry tissue 24 supported by the dispenser 20. Any excess solution remaining in the receptacle portion 52 after depleting the premoistened wipes 22 can be easily discarded by removal of the tray 50.

The removeability of the illustrated tray 50 also facilitates the reuse of the tray 50 by allowing the tray 50 to be removed for cleaning. For example, the tray 50 may be conveniently rinsed out in a bathroom sink. Additionally, by manufacturing the removable tray 50 entirely out of materials which are resistant to hot water having a temperature of approximately 180–210° F. (82–99° C.), the tray may be cleaned by placing it in a dishwasher. To facilitate the cleaning and disinfecting of the tray and other dispenser components, it is also advantageous that the materials used to form the tray and other components be resistant to isopropol alcohol, or solutions containing up to 70% isopropol alcohol, and be capable of withstanding disinfecting irradiation. The tray and other dispenser components may be advantageously formed by an injection molding process using an acrylonitrile butadiene styrene (ABS), polycarbonate, polypropylene, polyethylene, acetal or other suitable material. Those having ordinary skill in the art will recognize that these parts may be formed using a variety of alternative known materials and manufacturing techniques, e.g., machining.

Figure 19:
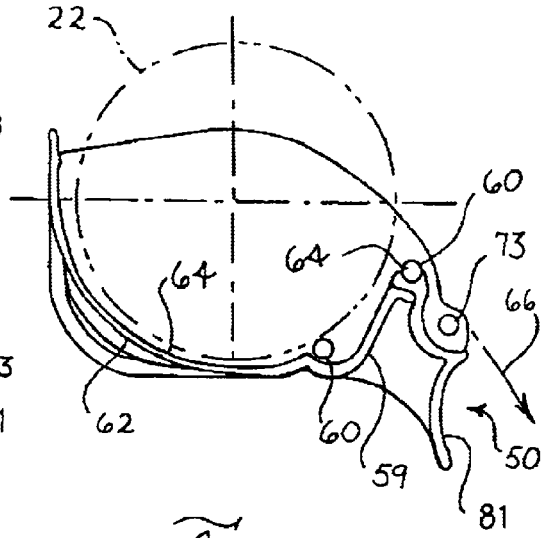
FIG. 19 is a cross sectional view of the tray taken along line A—A of FIG. 17.

When a roll of premoistened wipes 22 is placed in the tray 50 as shown in dashed outline in FIG. 19, the solution contained within the wipes may migrate downwards possibly leaving the wipes located on the upper portion of a stationary roll 22 with less moisture. The dispensing of the wipes, however, will cause the roll 22 to rotate within the tray and the solution retained by the receptacle portion 52 of the tray 50 will enhance the rewetting of the entire roll as it rotates within the tray.

The use of a tray having an impermeable lower surface 54 which is positioned below the wipes 22 and which does not form a liquid retaining receptacle can inhibit the soiling or wetting of the other components of the dispenser provided that the wipes are not overly saturated with solution. The use of a tray 50 which does include a liquid retaining receptacle portion 52, however, will generally be more advantageous.

In the illustrated tray, a pair of oppositely disposed side walls 56 are connected by the lower surface 54 and a laterally extending wall 58. The illustrated side walls 56 are spaced at a distance of 4.6 inches (11.68 cm) to provide 0.05 inches (0.13 cm) of clearance on each side of a roll 22 having an axial length of 4.5 inches (11.43 cm). The shape and size of the walls 56, 58 also permits the tray 50 to be tipped when inserting the tray 50 and a roll of premoistened wipes 22 into the dispenser without having the roll 22 fall from the tray 50.

The lower surface 54 includes a raised portion having a support surface 64. The premoistened wipes are placed within the interior space 32 on the support surfaces 64. The illustrated support surfaces 64 are located on the upper surface of ribs 62 and on two laterally extending rollers 60.

A relatively small laterally extending wall 59 is located between the two rollers 60 opposite wall 58. As exemplified by walls 58, 59, a receptacle portion 52 may be provided with walls which extend in a generally upwards direction when the tray 50 is installed in the dispenser 20. In other words, the walls are not required to be oriented perpendicularly to the lower surface 54 or define a vertical plane.

The two laterally extending rollers 60 are disposed opposite the laterally extending wall 58 whereby a substantial portion of the lower surface 54 is disposed between the roller 60 and the laterally extending wall 58. The premoistened wipes are supported by the ribs 62 in the central portion of the tray 50 while the two rollers 60 provide support at the dispensing end of the tray 50. FIG. 19 includes an arrow 66 which illustrates a path along which the premoistened wipes may be dispensed as they are unwound from roll 22.

As best seen in FIG. 1, the premoistened wipes placed in the tray 50 may be a coreless roll of premoistened wipes 22 having an axis 23. The premoistened wipes 22 advantageously have perforations (not illustrated) extending parallel to the axis and separating individual sheets of the rolled premoistened material to enable one or more sheets of the material to be conveniently separated from the remainder of the roll in a manner similar to that commonly employed with conventional dry bathroom tissue. The absence of a hollow core allows more wipes to be provided for a given roll diameter and eliminates the need for a disposable core. Alternative forms of premoistened wipes may also be used with a dispenser having a removable tray. For example, a stack of flat or folded individual or interconnected wipes or a roll of wipes having a core may be used.

In the illustrated tray 50, the ribs 62 are oriented substantially perpendicular to the axes of the freely rotatable rollers 60 and the axis 23 of the roll of premoistened wipes 22. By providing ribs 62 having relatively thin support surfaces 64 oriented perpendicular to the axis 23 of the wipes 22, the surface area of the wipes in contact with the support surfaces 64 is minimized. The minimal bearing surface area provided by the ribs 62 allows the wipes 22 to be rotated thereon without excessive frictional resistance. The ribs 62 may also extend upwardly along a portion of the laterally extending wall 58 as shown in the illustrated embodiment. By extending the ribs 62 upwardly along the wall 58, the ribs 62 space the roll 22 from the wall 58 to minimize the area of contact, and frictional forces, between the interior of tray 50 and the roll 22.

Figure 12:
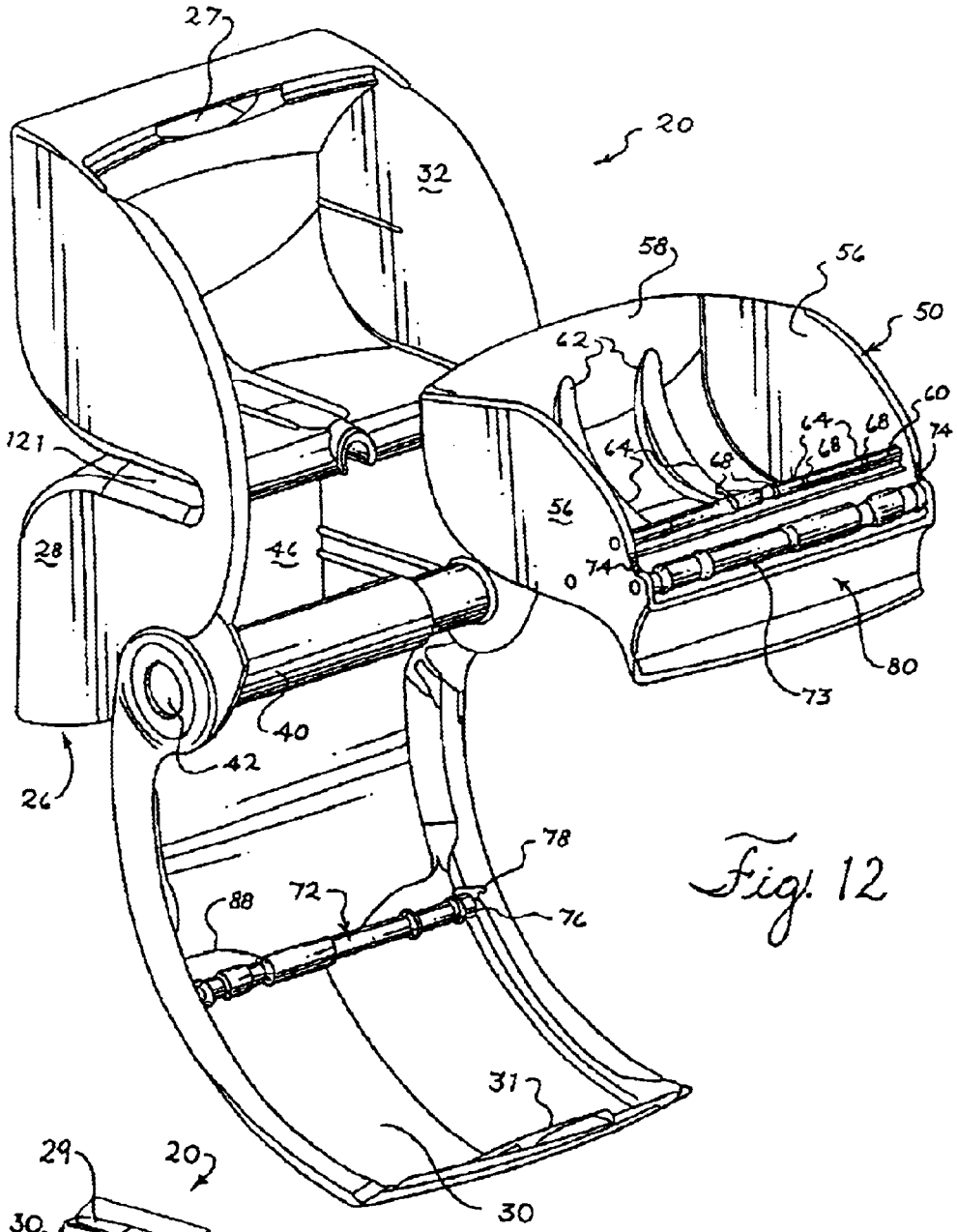
FIG. 12 is an exploded view of a tray and dispenser housing.
Figures 14, 15, 16:
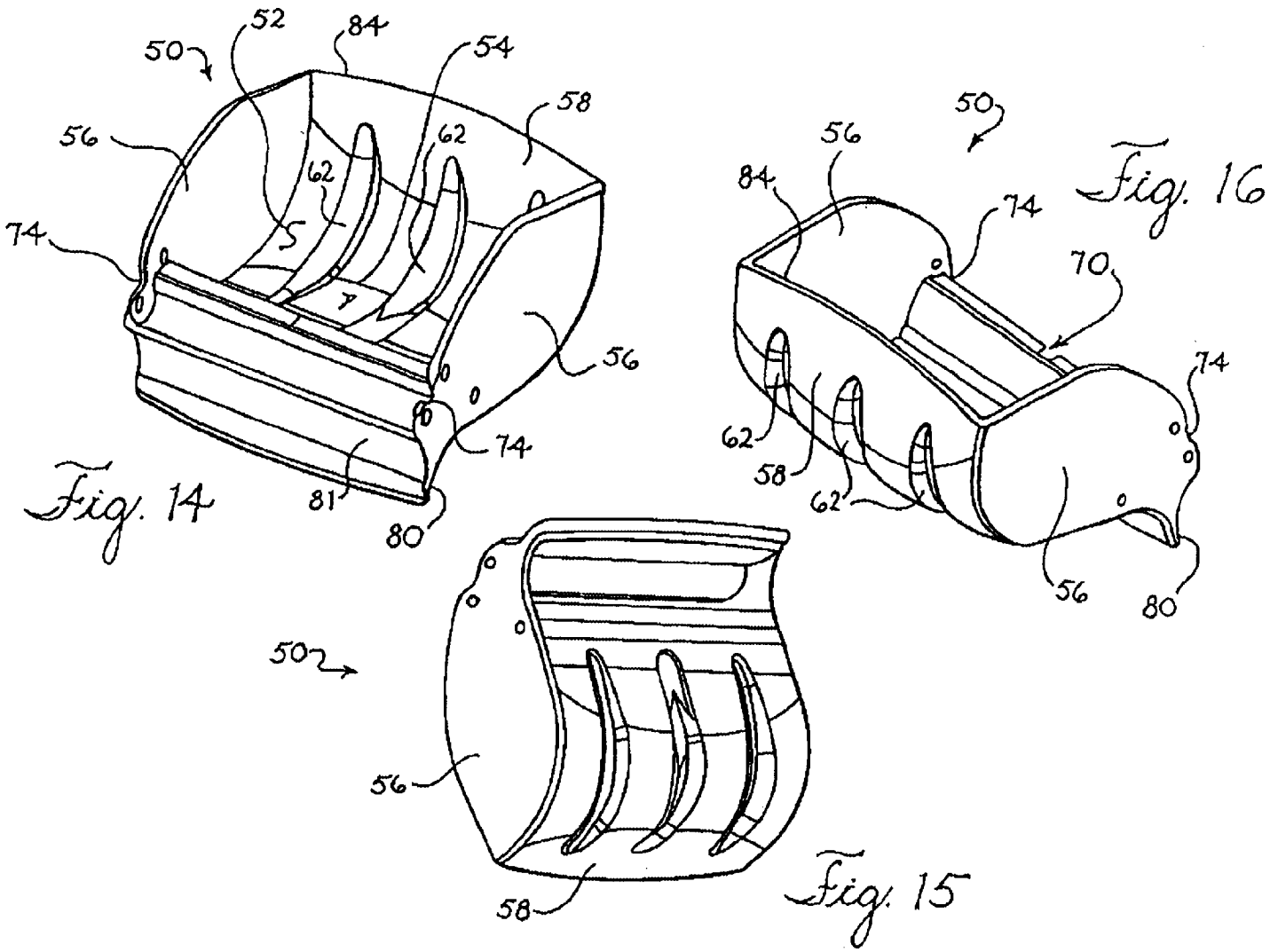
FIG. 14 is a perspective view of the tray.
FIG. 15 is another perspective view of the tray.
FIG. 16 is another perspective view of the tray.
Figure 17:
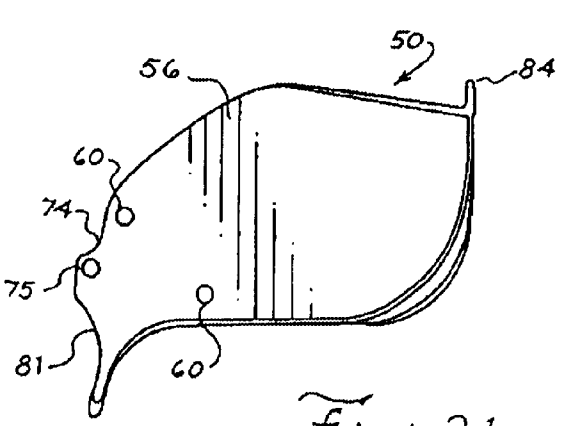
FIG. 17 is front view of the tray.
Figure 21:
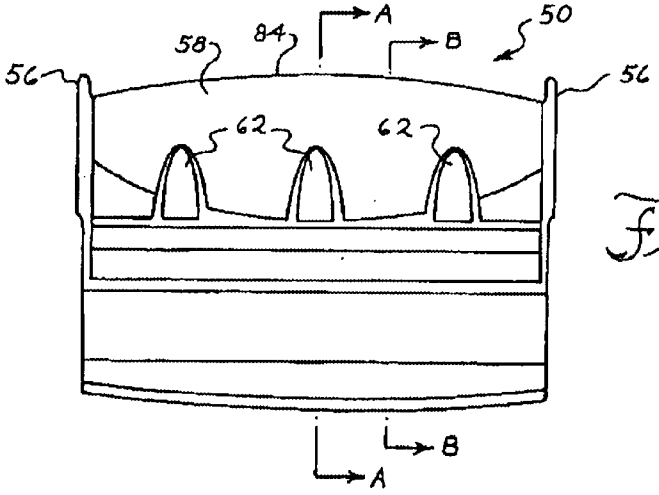
FIG. 21 is a side view of the tray.
Figure 20:
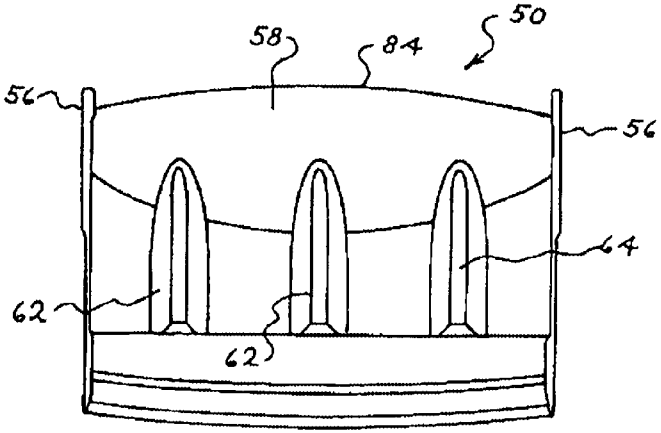
FIG. 20 is a bottom view of the tray.
Figure 22:
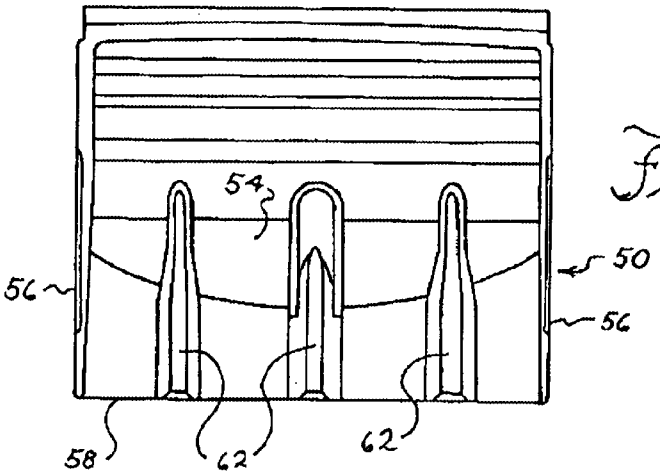
FIG. 22 is a top view of the tray.

The two rollers 60 are generally cylindrical with several spaced, cylindrical lands 68 having an increased diameter which provide support surfaces 64. The intermediate sections of rollers 60 which extend between lands 68 may also engage and support the premoistened wipes. The rollers 60 are rotatably supported by the tray 50 by inserting the ends of the rollers 60 into round apertures in the side walls 56. An intermediate support 70 is also provided for rotatably supporting one of the two rollers 60 as best seen in FIGS. 16 and 12.

The rollers 60 are disposed substantially parallel to the axis 23 of the rolled premoistened wipes 22 and are advantageously positioned to engage and support the rolled wipes near the side of the roll 22 from which wipes are being dispensed. As most easily seen with reference to FIG. 19, the roll of wipes 22 may be unwound by a user pulling the leading wipe which will move along the path indicated by the direction of arrow 66. As the leading wipe is being dispensed, the roll will be rotated and be pulled towards the rollers 60. The use of freely rotating rollers 60 provides a support for the roll 22 which enables the roll 22 to rotate with minimal frictional resistance.

A combination of both rollers 60 and ribs 62 are used in the illustrated tray 50 to provide a raised portion having a support surface and facilitate the rotation of the roll 22 within the tray 50. Alternative configurations for use with a roll of wipes 22, however, are also possible. For example, the roll 22 could be supported entirely by stationary support surfaces or rollers 60 and the stationary support surfaces or rollers could vary from those shown in the illustrated tray.

To load the tray with wipes, the premoistened wipes are positioned above the lower surface 54 and inward of the walls 56, 58. The wipes are conveniently placed into the tray 50 after first removing the tray 50 from the frame 28. Once the wipes have been placed in the tray 50 and the leading wipe draped over dispensing guide 73, the tray 50 and wipes 22 are then inserted into the interior space 32 as a single unit. Alternatively, the wipes 22 may be placed in the tray 50 while the tray is within the interior space 32.

After inserting the tray 50 and wipes 22, the cover 30 is closed whereby the leading wipe is engaged between the dispensing guide 73 located on the tray and the dispensing guide 72 located on the cover 30.

The illustrated dispensing guides 72, 73 are each rotatable about a longitudinally extending axis 72*a*, 73*a* and take the form of a cylinder having a plurality of lands 84 and grooves 86 along their longitudinal length. The dispensing guides 72, 73 have a pattern of lands 84 and grooves 86 which allow the land 84 of one dispensing guide 72 to be disposed opposite a groove 86 on the other dispensing guide 73. The illustrated pattern allows two identical dispenser guides to be employed by flipping one of the guides.

To ensure the proper positioning of the two dispensing guides 72, 73 when the cover 30 is placed in a closed position, the tray has a pair of engagement surfaces 74 located near the opposite lateral ends of the dispensing guide 73. The engagement surfaces 74 located on the tray 50 are engaged by a second pair of engagement surfaces 76 located on the cover 30 near the opposite lateral ends of the dispensing guide 72 (FIGS. 12 and 13).

Figure 13:
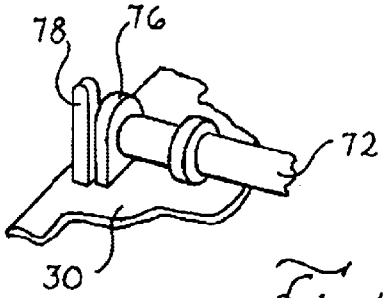
FIG. 13 is a partial perspective view of a dispensing roller.

FIG. 13 is an enlarged view of one of the lateral ends of the dispensing guide 72 located on the cover 30 and shows one of the engagement surfaces 76. The two pairs of engagement surfaces 74, 76 are engaged together when the cover 30 is placed in the closed position to facilitate the proper alignment of the two dispensing guides 72, 73. Also shown in FIG. 13 is a lateral alignment guide 78. The side walls 56 of the tray 50 are located between the two lateral alignment guides 78 when the cover 30 is closed and the two pair of engagement surfaces 74, 76 are engaged. The alignment guides 78 thereby prevent relative lateral movement between the cover 30 and the tray 50 and facilitate the proper lateral alignment of the two dispensing guides 72, 73.

In addition to the engagement surfaces 74, 76 which are located above the dispensing guide 73, the cover 30 and tray 50 also include another set of engagement surfaces on the opposite, lower side of the dispensing guide 73. These additional engagement surfaces are provided on a grip 80 located on the tray 50 and by projections 82 located on the cover 30. The grip 80 defines a laterally extending arcuate surface 81 which is engageable at its lateral ends by the projections 82. The arcuate grip surface 81 and projections 82 thereby contribute to the proper alignment of the cover 30 and the tray 50 and the dispenser guides 72, 73 located thereon.

The grip 80 is positioned so that it may be grasped when inserting or removing the tray 50 from the dispenser 20. The illustrated grip 80 not only provides a thin, easily gripped projection but the portion of the illustrated grip 80 which forms the exterior surface 81 which is visible when the dispenser is in a closed position also contributes to the aesthetic outward appearance of the dispenser 20 and conceals the threaded fastener 338.

In addition to the engagement of the grip 80 and the projections 82, the tray 50 may also be held in place by the engagement of the top edge 84 of wall 58 with a notch 86 in the interior surface of the frame 28. The engagement of edge 84 and notch 86 prevents the tray 50 from tipping forward as the leading wipe is being pulled during the dispensing process. The use of an arcuate edge 84 and notch 86, which are horizontally as well as vertically engageable, also helps to laterally locate the tray 50 within the frame 28. The top edge 84 may alternatively have a key, such as an upstanding tab, or key-way engageable with either a key-way or key on the frame 28 to securely position the tray 50 within the frame 28.

After inserting the tray 50 and wipes 22 into the dispenser, the wipes may be dispensed by pulling the leading wipe and separating a length of premoistened wipes from the remainder of the roll 22 by tearing the wipe material along a row of perforations separating the individual wipes. The removal of the wipes leaves a new leading wipe engaged between the dispenser guides 72, 73. The dispensing process may be repeated until the supply of wipes in the tray is depleted whereupon the tray 50 may be removed from the dispenser 20 and the wipes replenished.

Figure 8:
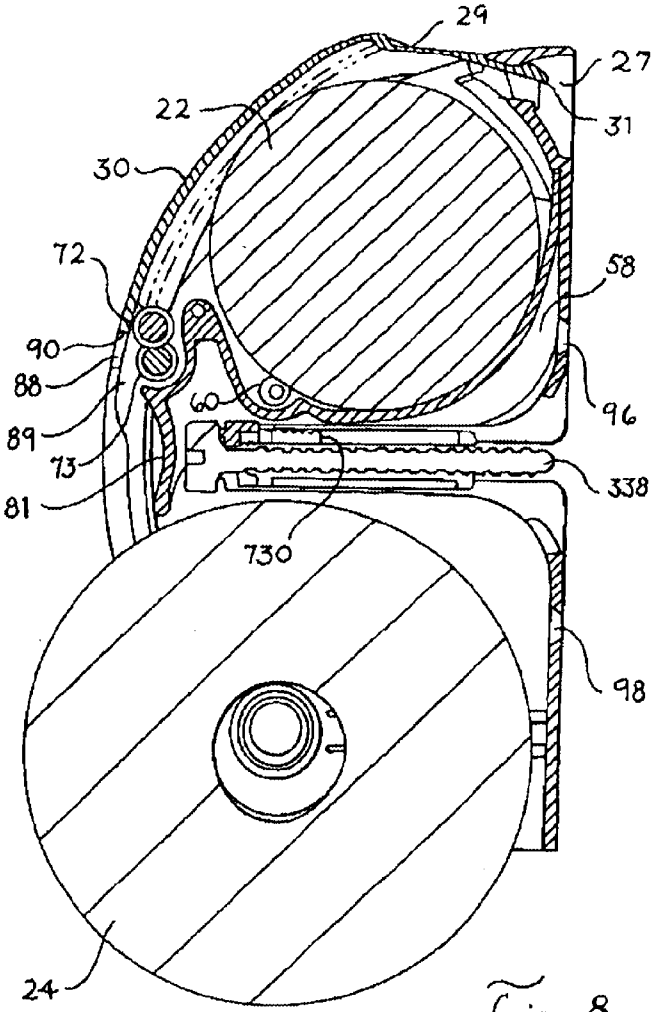
FIG. 8 is a cross sectional view taken along line 8—8 of FIG. 4.
Figure 7:
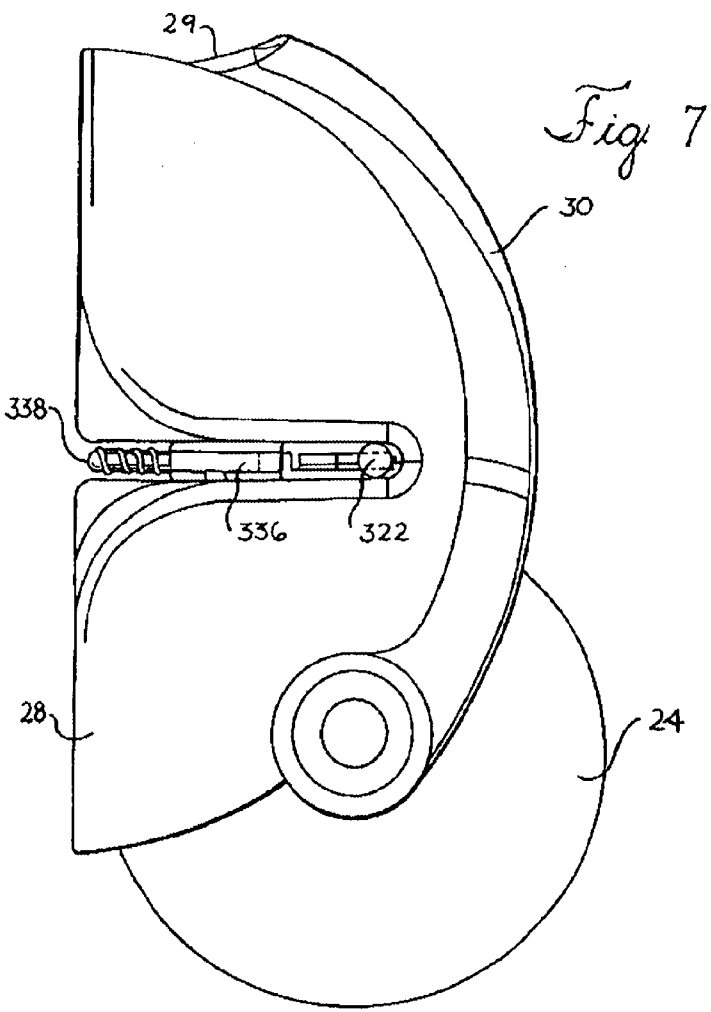
FIG. 7 is a side view of the dispenser of FIG. 3.
Figure 18:
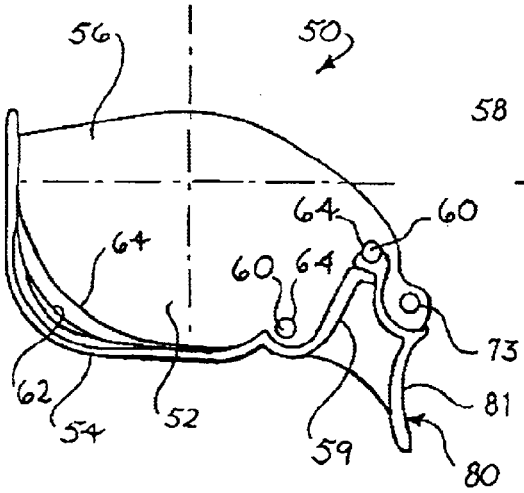
FIG. 18 is a cross sectional view of the tray taken along line B—B of FIG. 17.

A dispenser 21 which does not include projections 82 for engaging grip 80 is illustrated in FIGS. 3–8. FIG. 8 presents a cross sectional view taken along line 8—8 of FIG. 4 and illustrates the relationship between the dispensing guides 72, 73 and the impingement surface 88 of the representative embodiment. The impingement surface 88 is formed by an edge of the cover 30 and defines an edge of a dispensing opening 89.

Figure 9:
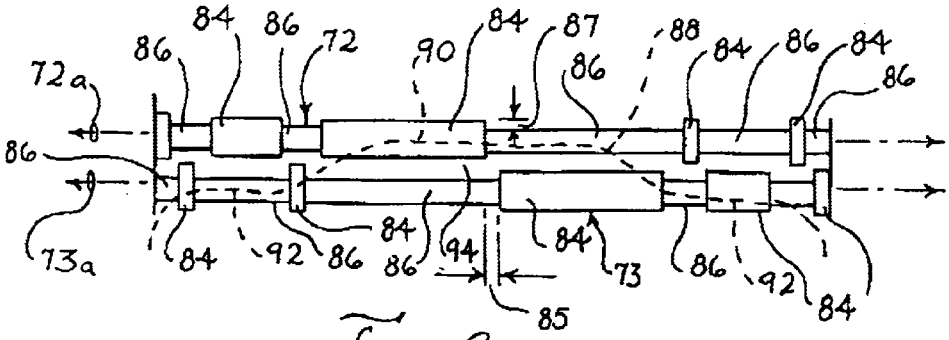
FIG. 9 is a front view of the dispensing rollers.
Figure 10:
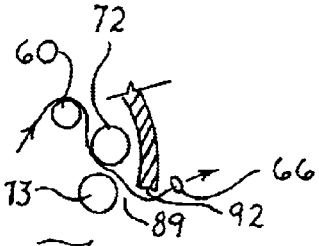
FIG. 10 is a schematic cross sectional view of the outer portion of the dispensing rollers.
Figure 11:
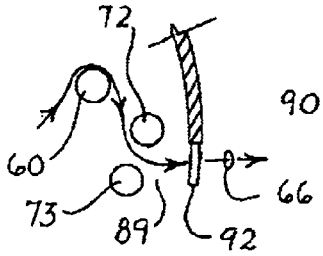
FIG. 11 is a schematic cross sectional view of the central portion of the dispensing rollers.

As schematically illustrated in FIGS. 9–11, the impingement surface 88 and opening 89 extend adjacent the dispensing guides 72, 73 when the cover 30 is in a closed position. As seen in FIG. 9, the impingement surface 88 includes a central portion 90 and two outer portions 92 located on opposite sides of the central portion 90. The central portion 90 is located at a first relative position with respect to the dispensing guides 72, 73 and the gap 94 formed between the guides 72, 73 through which the wipes are dispensed. The outer portions 92 of the impingement surface 88 are located at different relative positions to the dispensing guides 72, 73 than the central portion 90. The central portion 90 of the impingement surface 88 may advantageously have a generally rounded or curvilinear shape and be farthest from the gap 94 at the midpoint of the surface 88.

Figure 28:
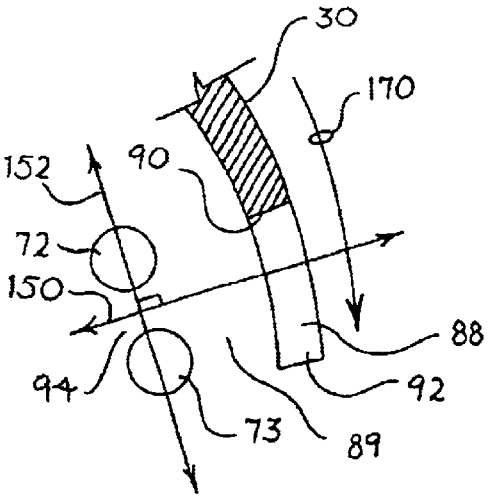
FIG. 28 is a schematic view of a dispensing system in accordance with the present invention.

With reference to FIGS. 9 and 28, the central portion 90 may be located on one side of the gap 94 and the outer portions 92 are located on the opposite side of the gap 94 when viewing the gap 94 at a normal angle. More specifically, a flat plane 150 intersecting the gap 94 and oriented perpendicularly to a plane 152 connecting the axes 72*a*, 73*a* of the dispenser guides 72, 73, lies within the dispensing opening 89 adjacent the central portion 90 of the impingement surface 88 while the outer portions 92 of the impingement surface 88 lie on the opposite side of the flat plane 150. Access to the central portion of the gap 94 is relatively unobstructed in such a configuration.

Figure 29:
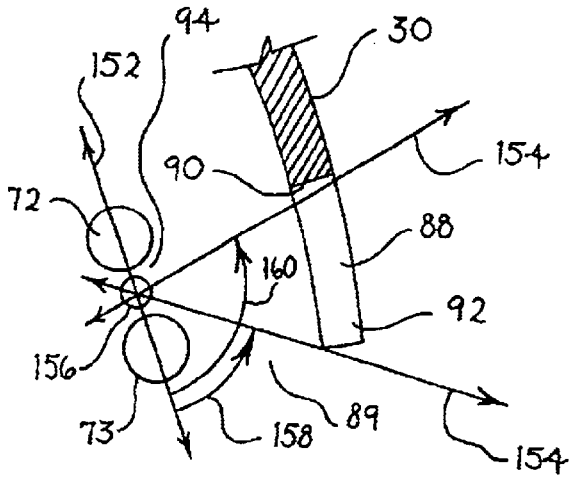
FIG. 29 is another schematic view of a dispensing system in accordance with the present invention.

With reference to FIG. 29, it can be seen that the illustrated dispensing system includes an impingement surface 88 having a central portion 90 which is disposed relative to the outer portions 92 to provide a more directly accessible gap 94 in the center of the dispensing opening 89. More specifically, a flat plane 154 intersecting the gap 94 and extending through the opening 89 will contact the two outer portions prior to contacting the central portion of the impingement surface when rotated about a line 156 (oriented perpendicular to the view and shown as a point in FIG. 29) of intersection with the gap 94 toward the impingement surface 88. As can be seen in FIG. 29, when rotated from a common location from the opening 89 toward the impingement surface, the plane 154 will rotate an angular distance 158 prior to contacting the outer portions 92 of the impingement surface 88 while the plane 154 must be rotated by a greater angular distance 160 to contact the central portion 90 of the illustrated impingement surface 88.

Figure 30:
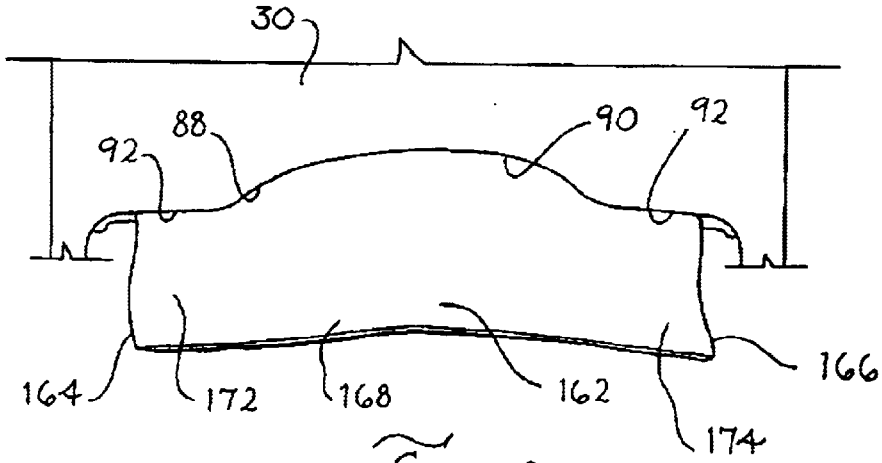
FIG. 30 is a partial view of a dispenser and a wipe.

The dispensing of wipes is best seen in FIGS. 10, 11 and 30. FIGS. 10 and 11 are schematic cross sectional representations which illustrate the direction of travel 66 of a wipe which is being dispensed. FIG. 30 provides a front view of a leading wipe 162 which may be grasped by a user. Each of the individual premoistened wipes provided on roll 22 includes a first side edge 164 and an opposite second side edge 166.

The leading wipe 162 is placed in the gap 94 in a substantially flat configuration when the gap 94 is formed between the two longitudinally extending dispensing guides 72, 73. This is accomplished in the illustrated embodiment by inserting the tray 50 into the dispenser 20 and closing the cover 30. After loading the premoistened wipes in the dispenser 20, the first and second side edges 164, 166 of the leading wipe 162 are disposed on opposite sides of the gap 94 and a forward edge 168 of the leading wipe 162 extends through the gap 94 where it may be easily grasped and dispensed.

The impingement surface 88 extends into the space through which the wipes are dispensed after passing through the gap 94. The impingement surface 88 extends in a direction 170 (FIG. 28) impinging on the wipe being dispensed. Thus, when the user pulls on the leading wipe to dispense one or more wipes, the impingement surface 88 may be engaged by the leading wipe 162. The wipe engages the outer portions 92 of the impingement surface 88 in first 172 and second 174 areas proximate the first 164 and second 166 side edges of the wipe. The outer portions 92 of the impingement surface 88 extend a greater distance than the central portion 90 in the impingement direction 170. Consequently, during the dispensing process, the outer portions 92 more forcibly engage the wipe than the central portion 90 of the impingement surface.

The outer portions 92 of the impingement surface may thereby provide a bearing surface against which the wipe may be pulled to initiate the separation of the dispensed wipes from the remaining wipes. During the separation process, the wipes are typically subjected to a lateral force which must be resisted to prevent the wipes from "skating" between the dispenser guides 72, 73 and "bunching up" at one location between the dispenser guides 72, 73.

The use of dispensing guides 72, 73 having corresponding lands 84 and grooves 86 provides resistance to the "skating" or "bunching up" of the wipe when the dispensed wipes are separated from the remainder of the premoistened wipes. In the illustrated embodiment, the lands 84 and grooves 86 of the dispensing guides 72, 73 are coordinated with the outer 92 and central 90 portions of the impingement surface whereby there are more alternations between lands 84 and grooves 86 adjacent the outer portions 92 of the impingement surface 88. As best seen in FIG. 9, the lands 84 and grooves 86 of the illustrated dispensing guides 72, 73 have a greater average longitudinal length adjacent the central portion 90 of the impingement surface 88 than the outer portions 92 of the impingement surface 88. The shorter average longitudinal length of the lands 84 and grooves 86 adjacent the outer portions 92 of the impingement surface 88 results in a higher concentration of alternations between the lands 84 and grooves 86 adjacent the outer portions 92 of the impingement surface 88.

The alternations between lands 84 and grooves 86 adjacent the outer portions 92 of the impingement surface 88 provide resistance to the "skating" or inward migration of the side edges 164, 166 of the wipe being dispensed. Increasing the number of alternations between the lands 84 and grooves 86 can provide an increased resistance to the skating of the wipe. Providing non-smooth texture, such as knurling, on the dispensing guides 72, 73 may also provide resistance to the skating of the wipes.

With reference to FIG. 9, when using wipes having a thickness of 0.010 inches (0.025 cm) it has been found advantageous to use dispensing guides 72, 73 wherein the outside diameter of the lands 84 is 0.380 inches (0.965 cm) and the outside diameter of the grooves 86 is 0.270 inches (0.686 cm). The radial distance 87 (FIG. 9) separating the lands 84 and grooves 86 at a transition point between a land and groove is consequently 0.055 inches (0.140 cm). It has been found advantageous to employ a longitudinal distance 85 separating adjacent transition points on the two dispensing guides which is three times larger than the distance 87 separating the land and groove surfaces. The gap 94 is advantageously sized to be smaller than, or approximately equivalent to, the thickness of the wipes 22 whereby the wipes will contact both of the dispensing guides 72, 73 as the wipes pass through the gap 94. For example, a gap 94 providing a clearance distance of 0.010 inches (0.025 cm) between the dispensing guides 72, 73 may be used with a wipe having a thickness of 0.015 inches (0.038 cm). It is noted that the directional lines 66 shown in FIGS. 10 and 11 merely indicate the path of travel of the wipe material without representing the thickness of the wipe.

Alternative embodiments of the invention may employ different dimensions for the gap 94, lands 84 and grooves 86. For example, alternative dimensions for the dispensing guides 72, 73 and gap 94 may be employed with wipes having similar thicknesses. The use of alternative dimensions for the dispensing guides 72, 73 and gap 94 may also be employed for wipes having different thicknesses. For example, it may be advantageous for wipes having a thickness in the range of 0.300 mm (0.012 inches) to 1.300 mm (0.051 inches) to employ gaps 94 in the range of 0.178 mm (0.007 inches) to 1.17 mm (0.046 inches) wherein the gap size varies linearly with the wipe thickness. These combinations of wipe thickness and gap 94 size are merely illustrative and alternative combinations may also be employed.

Different sized gaps 94 can be easily provided with the same dispenser by exchanging one or both of the dispensing guides 72, 73. For example, to provide a larger gap 94, the illustrated dispensing guides 72, 73 could be exchanged for guides which have lands and grooves with smaller diameters than the illustrated dispensing guides discussed above. Although rotatable dispensing guides 72, 73 are shown in the representative embodiment, alternative embodiments may employ stationary surface to form a gap 94. Furthermore, by resiliently biasing one of the dispenser guides towards the second dispenser guide, such as by one or more springs, a dispenser having a variable gap 94 may be provided.

In addition to facilitating the separation of the dispensed wipes, the engagement of a wipe by the outer portions 92 of the impingement surface 88 may also produce a drag on the wipe during the dispensing process. The central portion 90 of the impingement surface 88 may also engage and produce a drag on the wipe. Depending upon the angle at which the wipe is pulled during dispensing, however, the premoistened wipes may not engage the central portion 90 of the impingement surface 88 during the dispensing process.

Some drag is desired during the dispensing process to prevent an excessive quantity of wipes from being dispensed as a result of a minor pulling motion. In the illustrated embodiments, it has been found that an advantageous level of drag can be produced by positioning approximately equal amounts of the impingement surface 88 on opposite sides of flat plane 150.

Figure 27:
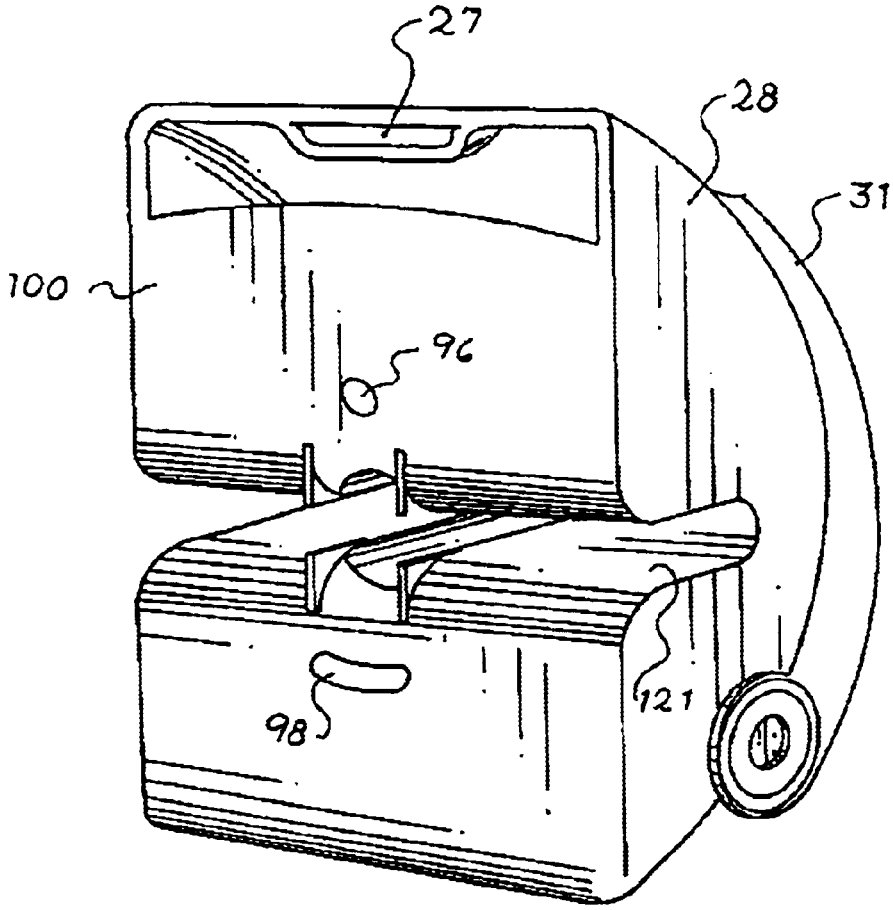
FIG. 27 is a perspective view of the rear of the dispenser of FIG. 2.

The dispenser may also be directly mounted to a wall, cabinet panel or similar support by inserting fasteners through apertures located in the rear surface of the frame 28. The apertures in the rear surface 100 of the frame 28 may include a round aperture 96 adapted to receive a threaded fastener therethrough. The aperture 96 may be advantageously positioned to correspond with the middle rib 62 of the tray whereby the void space defined by the rear of the middle rib 62 will overlay the head of the installed fastener to reduce the possibility of clearance difficulties between the fastener head and the tray. The rear surface of the frame 28 may also include another aperture 98 located below the above-described round aperture as shown in FIG. 27.

Alternatively, a mounting device 320 may be used to support the dispenser 20 on a conventional bathroom tissue fixture having a pair of opposed recesses for receiving a telescoping roll bar. A suitable mounting device is described in detail in a commonly assigned U.S. Patent Application entitled "Mounting Device" having an Attorney Docket No. 14,674, Ser. No. 09/302,356 filed Apr. 30, 1999, the disclosure of which is hereby incorporated by reference.

The mounting device 320 fits within a slot 121 in the frame 28 and is secured to the frame 28 with fastener 338. To accommodate a wide variety of conventional fixtures, the mounting device 320 can be secured at different positions along slot 121. For recessed fixtures, the mounting device 320 can be turned so that the curved end 123 of the mounting device 320 is inserted first into the slot 121 and the support arms 322, 324 can be located behind the rear surface 100 of the dispenser 20. Alternative mounting devices for attaching the dispenser 20 to a conventional bathroom tissue fixture may also be employed.

Figure 31:
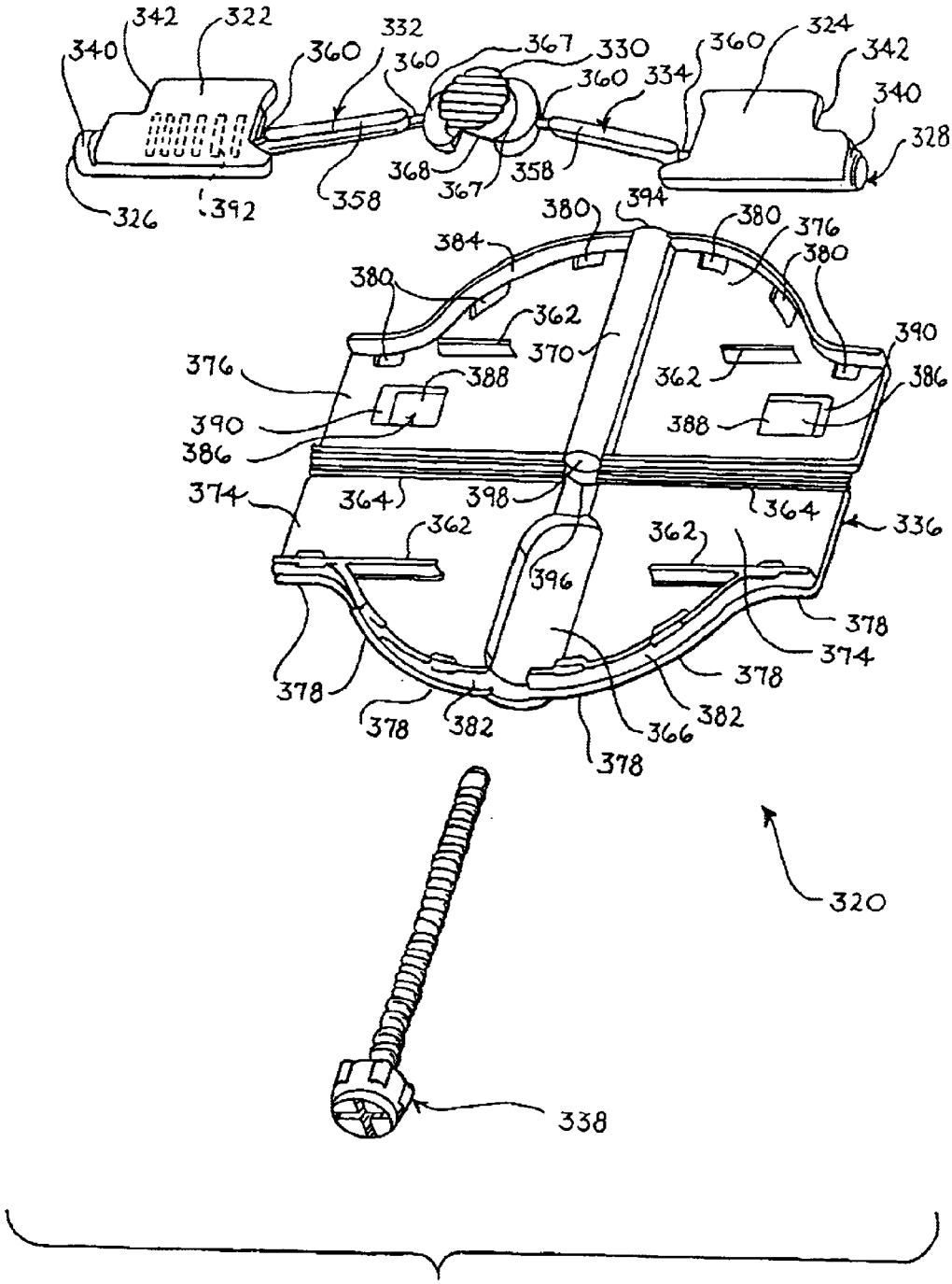
FIG. 31 is an exploded view of a mounting device.

The mounting device 320 is illustrated in an exploded view in FIG. 31. The mounting device 320 includes two support members 322 and 324 each of which includes a distal end 326 and 328. The support members 322, 324 are connected to a positioning member 330 by linkages 332 and 334. The support members 322, 324 are received within a housing 336. A threaded fastener 338 is used in the attachment of a dispenser to the mounting device 320.

The mounting device 320 may be used with conventional bathroom tissue fixtures which are commonly found in residential and commercial buildings. FIGS. 34 and 35 show two examples of such conventional bathroom tissue fixtures. The fixture 344 illustrated in FIG. 34 has a recessed portion 346 and two short extensions 348 having a pair of oppositely disposed recesses 350 (only one is visible in FIG. 34) which may receive the ends of a conventional roll bar. The conventional fixture 352 shown in FIG. 35 includes two posts 354 which also include a pair of oppositely disposed recesses (not visible) for receiving the ends of a conventional telescoping roll bar 356.

Figure 33:
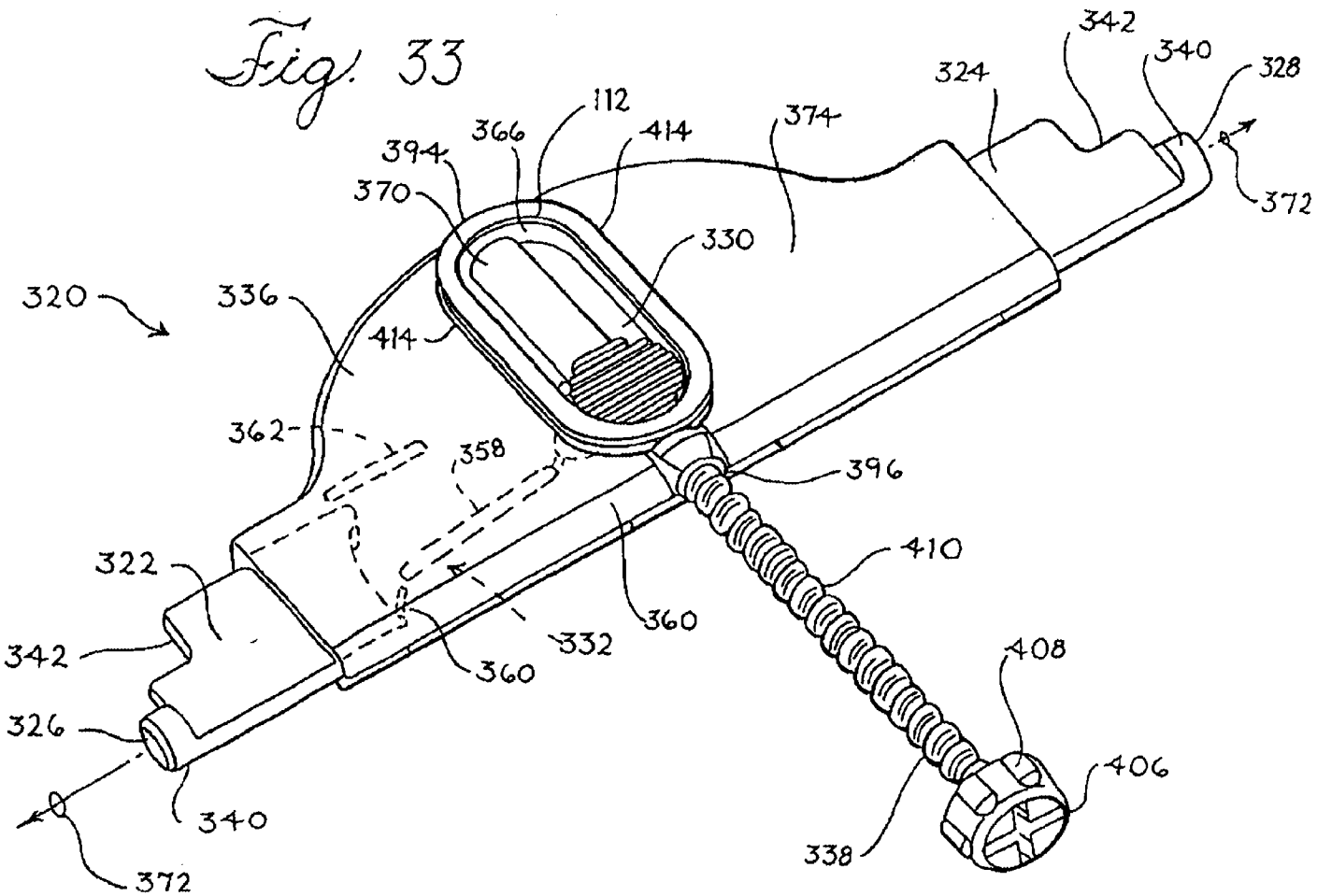
FIG. 33 is a perspective view of a mounting device with the support members in an extended position.
Figure 36:
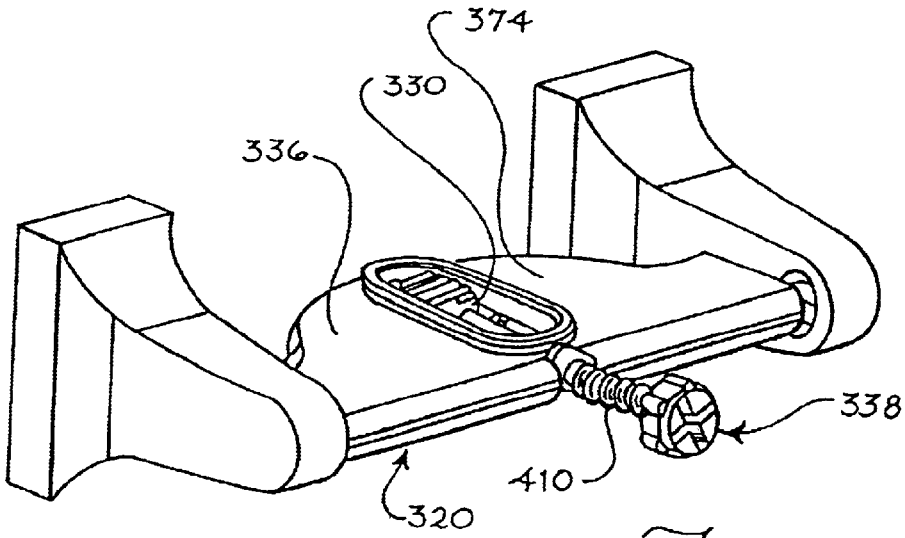
FIG. 36 is a perspective view of a mounting device engaged with a conventional bathroom tissue fixture.

As best seen in FIGS. 31 and 33, the distal ends 326, 328 of the support members 322, 324 are formed by cylindrical sections 340 and stepped portions 342. When the mounting device 320 is employed with conventional bathroom tissue fixtures, the distal ends 326, 328 are engaged with the pair of oppositely disposed recesses that would otherwise receive the opposite ends of a conventional roll bar. FIG. 36 illustrates a mounting device 320 with the distal ends 326, 328 of its support members 322, 324 engaged with the oppositely disposed recesses of a conventional bathroom tissue fixture.

The use of a relatively small cylindrical portion 340 and a stepped portion 342 to form the distal ends 326 and 328 allows the distal ends 326, 328 to be engaged with a variety of differently sized recesses or openings. For example, the small cylindrical portions 340 will fit into relatively small recesses while the distal segment of the stepped portion 342 from which the cylindrical portion 340 extends is sized to fit within the recesses of most conventional bathroom tissue fixtures. The use of such a graduated distal end allows the distal end to fit within both small and large recesses while also minimizing the potential for relative movement of the distal end within the recess.

The support arms 322, 324 of the mounting device illustrated in FIGS. 3–33 are connected with the positioning member 330 with linkages 332 and 334. The linkages each include a central rigid portion 358 and pivotal connections 360 linking the rigid portion 358 to the support arm and positioning member 330. In the assembled mounting device 320, the movement of support arms 322, 324 is constrained by guides 362 and hinges 364 which limit the support arms 322, 324 to lateral movement. The positioning member 330 is disposed within guide slot 366 which limits the positioning member 330 to longitudinal movement. The positioning member 330 also includes a groove 368 which is adapted to mate with a cylindrical portion 370. The cylindrical portion 370 extends longitudinally and is located centrally within guide slot 366 in the assembled mounting device 320. The cooperative engagement of positioning member 330 and cylindrical portion 370 also limits the positioning member 330 to longitudinal movement and prevents the rotation thereof.

In the assembled mounting device 320, a shoulder 367 along the outer perimeter of the positioning member 330 is positioned between opposing panels 374 and 376 of the housing. The reciprocal longitudinal movement of the positioning member 330 causes the support members 322 and 324 to move inwardly and outwardly in a lateral direction due to the action of linkages 332 and 334 and the constrainment of the support members 322, 324 between guides 362 and hinges 364. The movement of the positioning member 330 from the position illustrated in FIG. 32 to the position illustrated in FIG. 33 causes the support arms 322 and 324 to both move relatively outwardly. The distal ends move together with support arms 322 and 324 during such relative motion of support arms 322 and 324 and this relative movement of the distal ends 326 and 328 defines a lateral axis 372. By aligning the lateral axis 372 with the oppositely disposed recesses of a conventional bathroom tissue fixture and moving the positioning member 30, the distal ends 326 and 328 may be engaged with the recesses and the mounting device 320 may be mounted to the fixture as exemplified by FIG. 36.

Either guide slot 366 or the cooperative engagement of the groove 368 and cylindrical portion 370 could be used by itself as a guide to limit or control the movement of the positioning member 330. In the illustrated embodiment, both the guide slot 366 and cylindrical portion 370 act to limit the positioning member 330 to longitudinal movement which is angularly oriented to the lateral axis 372. The movement of the positioning member 330 may be advantageously oriented at a perpendicular angle to the lateral axis as shown in the illustrated embodiment.

Alternatively, a different configuration of support arms and linkages could be used whereby it would be desirable to have positioning member 330 move in a different direction relative to the lateral axis 372 to obtain the desired movement of the distal ends 326, 328. Still further alternative embodiments of the mounting device, such as that illustrated in FIGS. 41 and 42 and discussed below, may be used which do not rely upon a linkage to obtain the desired movement of the distal ends 326, 328.

As used herein, the term "linkage" refers to any part which interconnects two bodies whereby movement of one of the bodies causes the linkage to effectuate movement of the other body.

In the illustrated embodiment of mounting device 320, both support members 322 and 324 move relative to housing 336. In alternative embodiments, however, one of the support members could be affixed to the housing or formed integrally with the housing whereby only one of the support members would move relative to the housing. In such an embodiment, movement of the one support member would still result in relative movement between the two support members and the distal ends 326, 328 could be engaged and disengaged with a pair of oppositely disposed recesses.

The support arms 322, 324; linkages 332, 334; and positioning member 330 may be formed as a single integral unit. The support arms 322, 324, linkages 332, 334 and positioning member 330 may be advantageously formed by injection molding a polypropylene or acrylonitrile butadiene styrene (ABS) material. The housing 336 and threaded fastener may also be formed by injection molding a polypropylene or ABS material. Polycarbonate, polyethylene, acetal and other suitable materials may also be used. Those having ordinary skill in the art will recognize that these parts may be formed using a variety of alternative known materials and manufacturing techniques, e.g., machining.

The illustrated housing 336 includes two panels 374 and 376 which are connected by hinges 364. The housing also includes a plurality of projections 378 along the edge of one panel 374 which engage corresponding apertures 380 in the other panel 376. The projections 378 slightly overhang edge wall 382. Hinges 364 permit the two panels 374 and 376 to be pivoted relative to each other and allow projections 378 to mate with apertures 380. Projections 378 are biased inwardly as they are inserted through apertures 380 and snap resiliently outwardly after passage through apertures 380 to securely engage opposite edge wall 384 in a "snap-fit" and maintain the housing in a closed position.

When the illustrated mounting device 320 is assembled, the support members 322 and 324 are partially disposed within the housing 336 with the distal ends 326, 328 extending outwardly from the housing 336. In the illustrated device 320, the two linkages 332 and 334 are also located within the housing 336.

The illustrated embodiment 320 also includes a latching mechanism 386. The illustrated latching mechanism 386 includes a resilient projecting arm 388 which includes an engagement tip 390 at its free end as best seen in FIG. 43. The engagement tip 390 moves toward and away from the adjacent support member 322, 324 as the tip 390 progressively engages a plurality of individual indentations 392 in the support member 322,324 as the support member 322, 234 is moved along the lateral axis. In the embodiment illustrated in FIG. 31, the indentations 392 are located on the surface of the support members 322, 324 which are not shown, however, the location of the indentations 392 on support member 322 is illustrated with dashed lines.

By providing two latching mechanisms 386, each providing engagement between the housing 336 and one of the two support members 322, 324, the relative motion between the two support members 322, 324 may be inhibited by the engagement of the latching mechanisms 386 with the support members 322, 324. In alternative mounting devices, a single latching mechanism may be sufficient to inhibit the relative motion between support members 322, 324. For example, if one of the support members was not moveable relative to the housing, a single latching mechanism engaging the moveable support member to the housing would be sufficient to inhibit relative motion between the two support members. A single latching mechanism which directly engaged the two support members would also inhibit relative motion between the two support members 322, 324.

In the illustrated latching mechanism 386, the engagement and disengagement of the tip 390 with the individual indentations 392 does not require significant force, thereby readily allowing a user of the mounting device 20 to move the support arms 322, 324 inwardly and outwardly. The support arms 322, 324, however, may also be subjected to vibrational forces and movement relative to the fixture during use. Consequently, the inhibition of relative motion between the support arms 322, 324 by the engagement of the tip 390 with an individual indentation 392 inhibits the disengagement of the support arms with the opposed recesses 350 of a fixture after installation of the mounting device 20.

Alternative latching mechanisms 386 may also be employed to inhibit the relative motion between support members 322, 324. For example, a projecting tip located on the support member could engage corresponding indentations on the housing or the frictional engagement between a support member and the housing or the other support member could be sufficiently high to inhibit the relative movement between the support members 322, 324.

The illustrated housing 336 also includes an attachment mechanism formed by threaded bore 398 and threaded fastener 338 which may be used to attach a dispenser to the housing 336. Alternative attachment mechanisms such as a "snap-fit" or a frictional engagement between the housing and dispenser may also be used to attach the mounting device to a dispenser or other object.

Suitable dispensers for use with the mounting devices of the present invention include dispensers adapted to provide both dry and premoistened wiping products. Examples of such dispensers are described in detail in commonly assigned U.S. Patent Applications entitled "Dispenser and Tray for Premoistened Wipes" and "Dispensing System and Method for Premoistened Wipes" having Attorney Docket Nos. 14,675 and 14,868 and both filed Apr. 30, 1999, the disclosures of which are hereby incorporated by reference.

In an installed condition, the illustrated support members 322, 324 supportingly engage the housing 336 which, in turn, is attached to or otherwise engages the dispenser 400 to thereby conveniently mount the dispenser 400 to a conventional bathroom tissue fixture. In alternative embodiments, the support members could directly support the dispenser.

Figure 39:
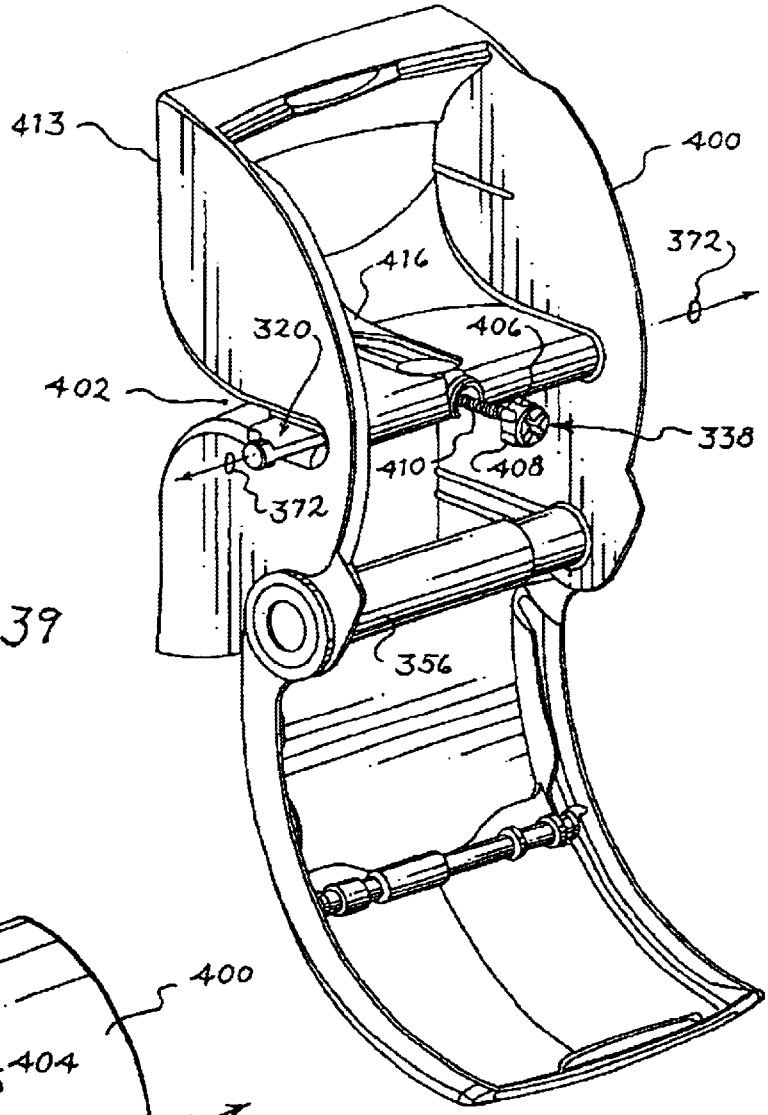
FIG. 39 is a perspective view of a mounting device and a dispenser.

The illustrated housing 336 includes two separate threaded openings 394 and 396. The threaded fastener 338 may be engaged with either opening 394 or 396. A single threaded bore 398 extends the entire length of cylindrical portion 370 to form both threaded openings 394 and 396, however, multiple threaded bores may also be used to provide a plurality of threaded openings for receiving a threaded fastener. As discussed below, the selection of which opening 394, 396 into which to insert the threaded fastener 338 may depend upon the fixture to which the mounting device is being secured. For example, if the fixture recessed into a wall or cabinet (FIG. 34) it may be advantageous orient the mounting device and dispenser so that the fastener 338 is inserted into opening 394 while if the fixture which extends outwardly (FIG. 35) it may be advantageous to insert the fastener 338 into opening 396 as shown in FIG. 39. The configuration of the dispenser 400 or other object being attached to the mounting device 320 may also influence the selection of which opening into which to insert fastener 338.

Figure 32:
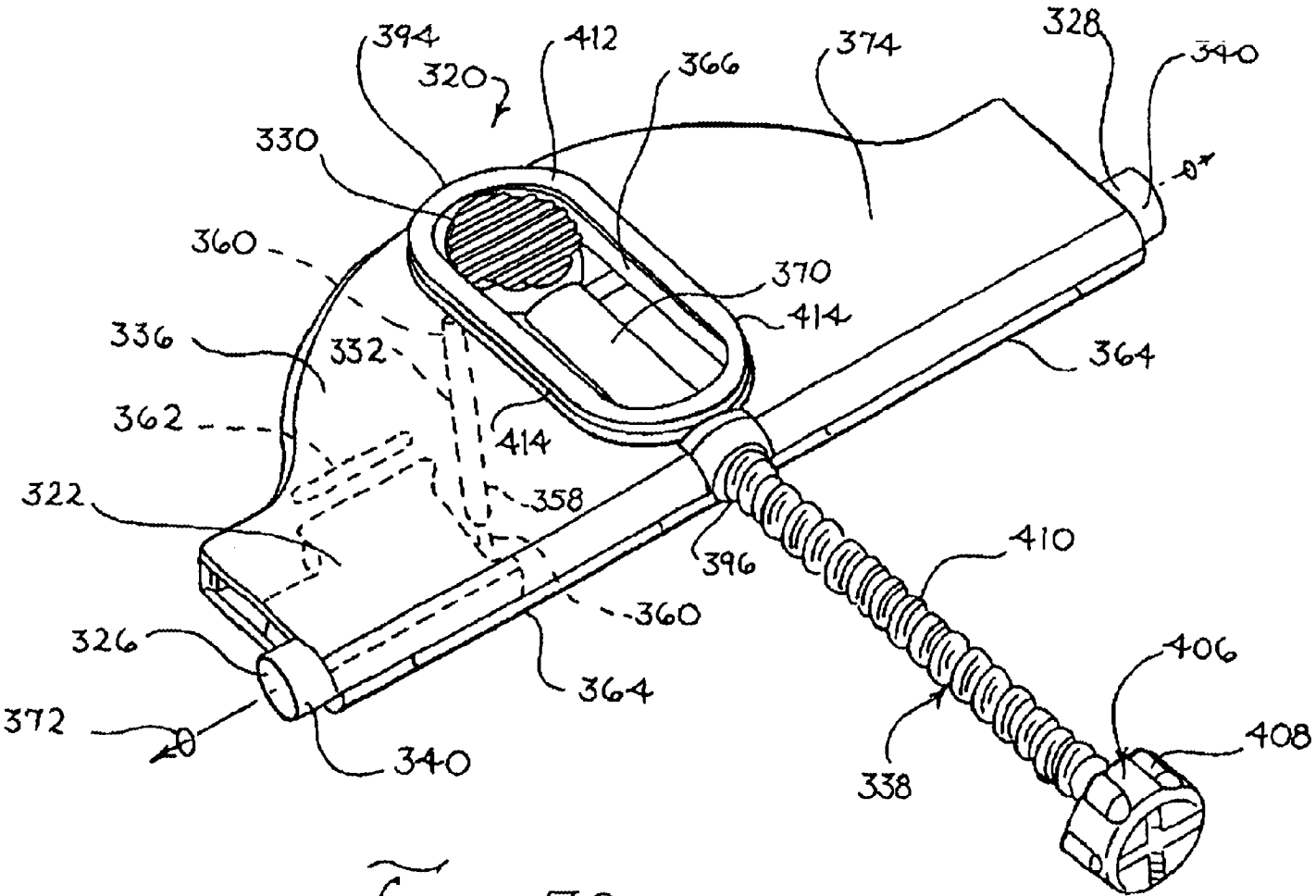
FIG. 32 is a perspective view of a mounting device with the support members in a retracted position.

As can be seen in FIGS. 32 and 33, the assembled housing 336 has its largest longitudinal dimension extending from opening 394 to opening 396. The lateral axis 372 is asymmetrically positioned with respect to this longitudinal dimension of the housing. By asymmetrically positioning the lateral axis 372 defined by the distal ends 326, 328, the housing may be engaged to a dispenser 400 or other object at different locations on the housing to thereby allow the dispenser 400 to be mounted at different relative positions with respect to the lateral axis. This result may alternatively be achieved with a symmetrically placed lateral axis and asymmetrically located attachment locations. This ability facilitates the use of the mounting device 320 with a wide variety of different bathroom tissue fixtures. For example, by positioning the lateral axis 372 at different longitudinal locations along a slot 402 in the dispenser 400, a single mounting device 320 and dispenser 400 may be used with either a recessed fixture 344 or an outwardly extending fixture 352 to position the rear of the dispenser 400 flush with the wall or cabinet to which the fixture is mounted.

Figure 40:
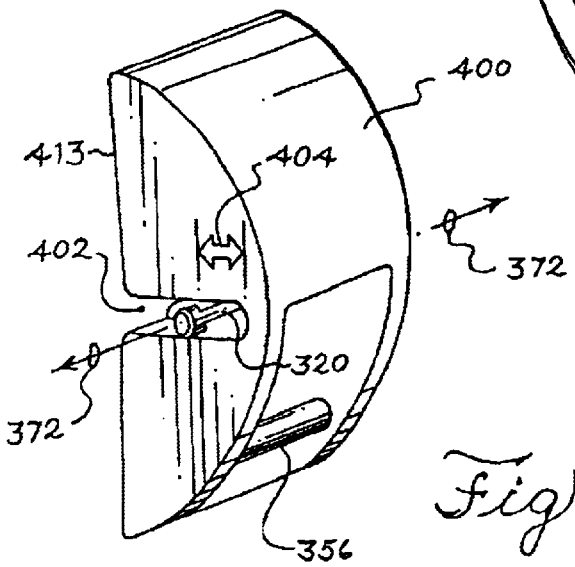
FIG. 40 is a perspective view of a mounting device and a dispenser.
Figure 44:
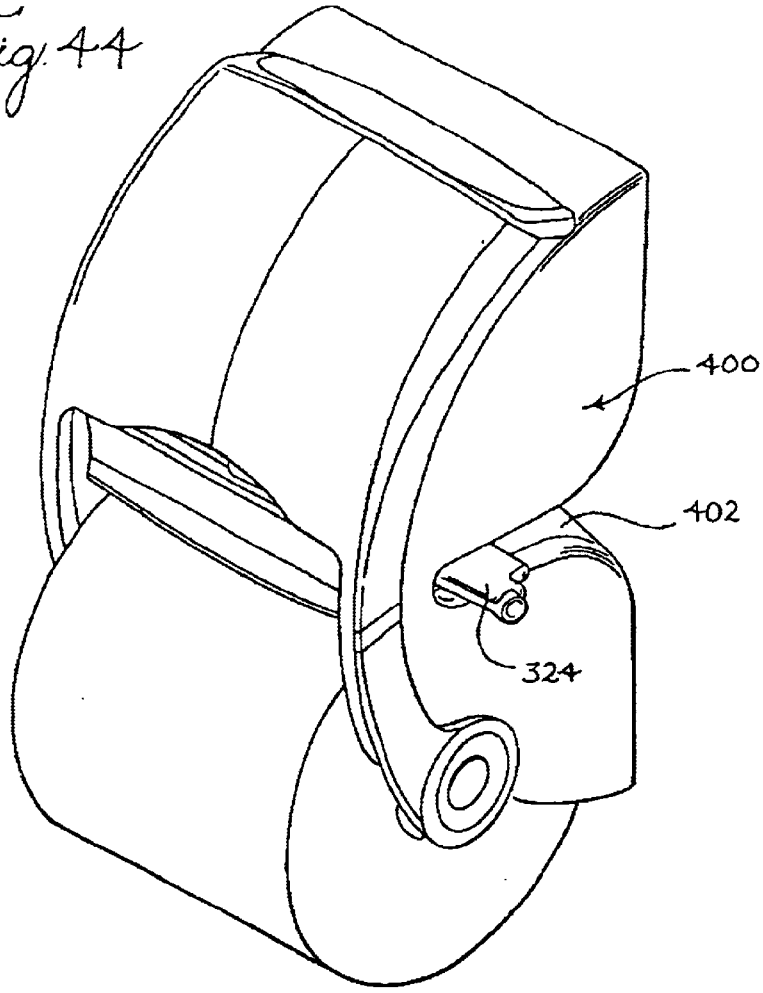
FIG. 44 is a perspective view of a mounting device and a dispenser.
Figure 45:
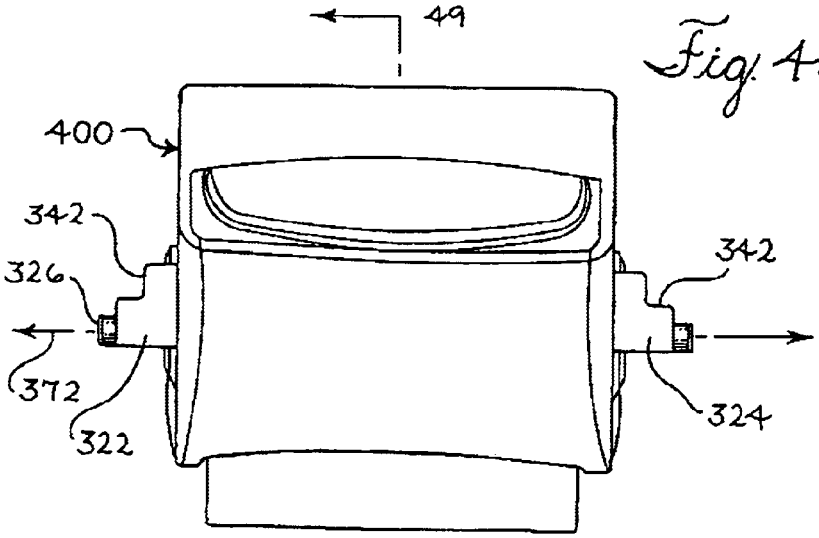
FIG. 45 is a top view of the mounting device and dispenser of FIG. 44.
Figure 47:
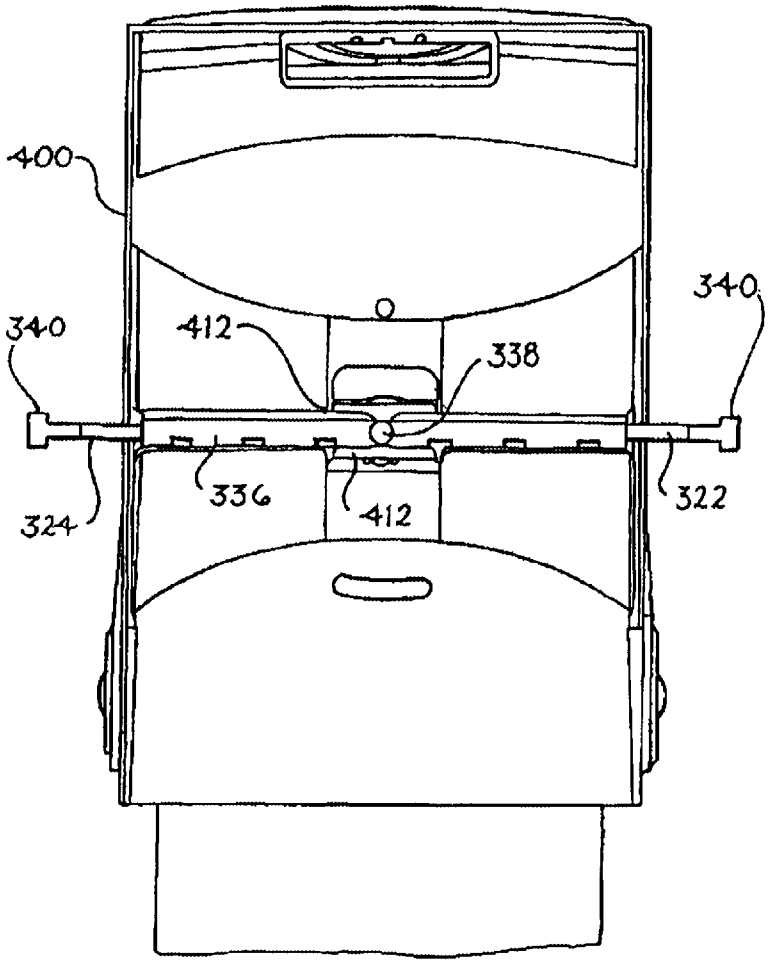
FIG. 47 is a rear view of the mounting device and dispenser of FIG. 44.
Figure 46:
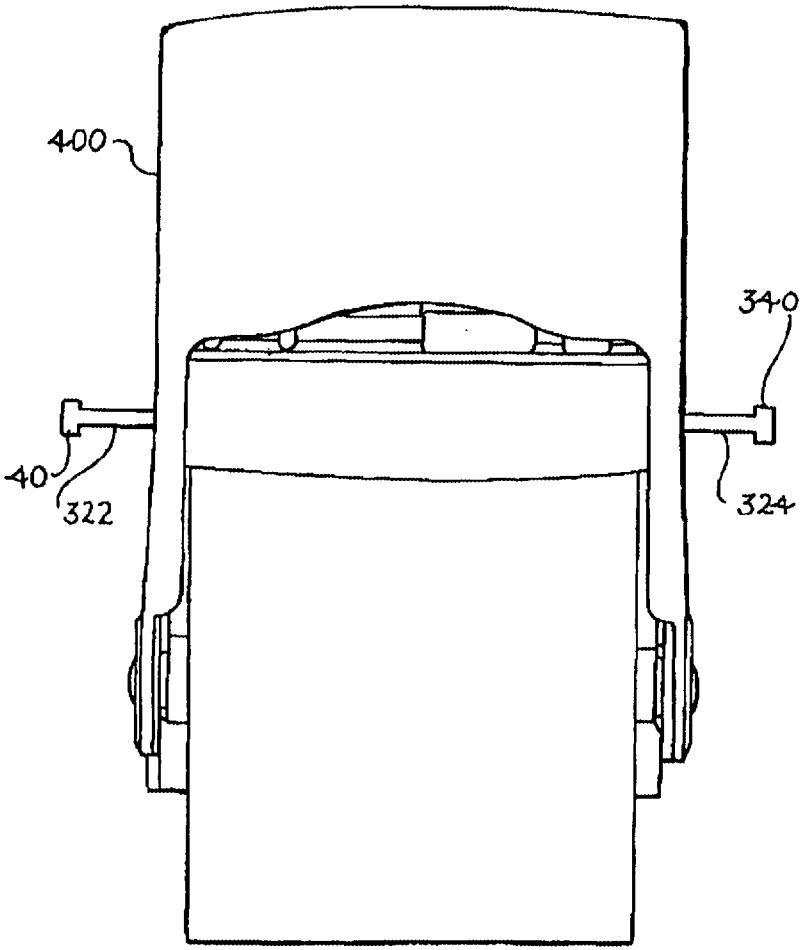
FIG. 46 is a front view of the mounting device and dispenser of FIG. 44.

As can be seen in FIGS. 39 and 40, by inserting the mounting device 320 into the dispenser slot 402 to varying degrees, the lateral axis 372 may be located at different relative positions with respect to the dispenser 400. The double arrow 404 (FIG. 40) shows the difference in longitudinal positions of the two lateral axis locations in FIGS. 39 and 40.

The threaded fastener 338 is shown in FIG. 39 prior to its engagement with the dispenser 400. To complete the attachment of the dispenser 400 to the mounting device 320, the threaded fastener 338 is turned until fastener head 406 engages the dispenser 400. As can be seen in FIG. 39, the fastener head 406 may include slots which permit the use of either a flat-head or a phillips head screwdriver. A relatively large fastener head 406 with ridges 408 on the outer perimeter thereof allows the fastener head 406 to be easily gripped and turned by the user's fingers and thereby permit the dispenser 400 to be attached without the use of tools. The use of threads 410 having a relatively large pitch, i.e., extending over a relatively long length of shaft per revolution, minimizes the number of times the fastener 338 must be turned during installation and thereby facilitates installation in the absence of tools. The tightening of the threaded fastener 338 to engage the dispenser 400 will cause the rear surface 413 of the dispenser 400 to engage the wall or cabinet panel disposed behind the dispenser 400.

The attachment mechanism may be adapted to permit the dispenser to be attached to the housing in different positions whereby the lateral axis has a different relative position with respect to the dispenser in at least two different positions. When the lateral axis is asymmetrically placed, this may further expand the different relative positions between the lateral axis and attached dispenser which are possible.

Figure 37:
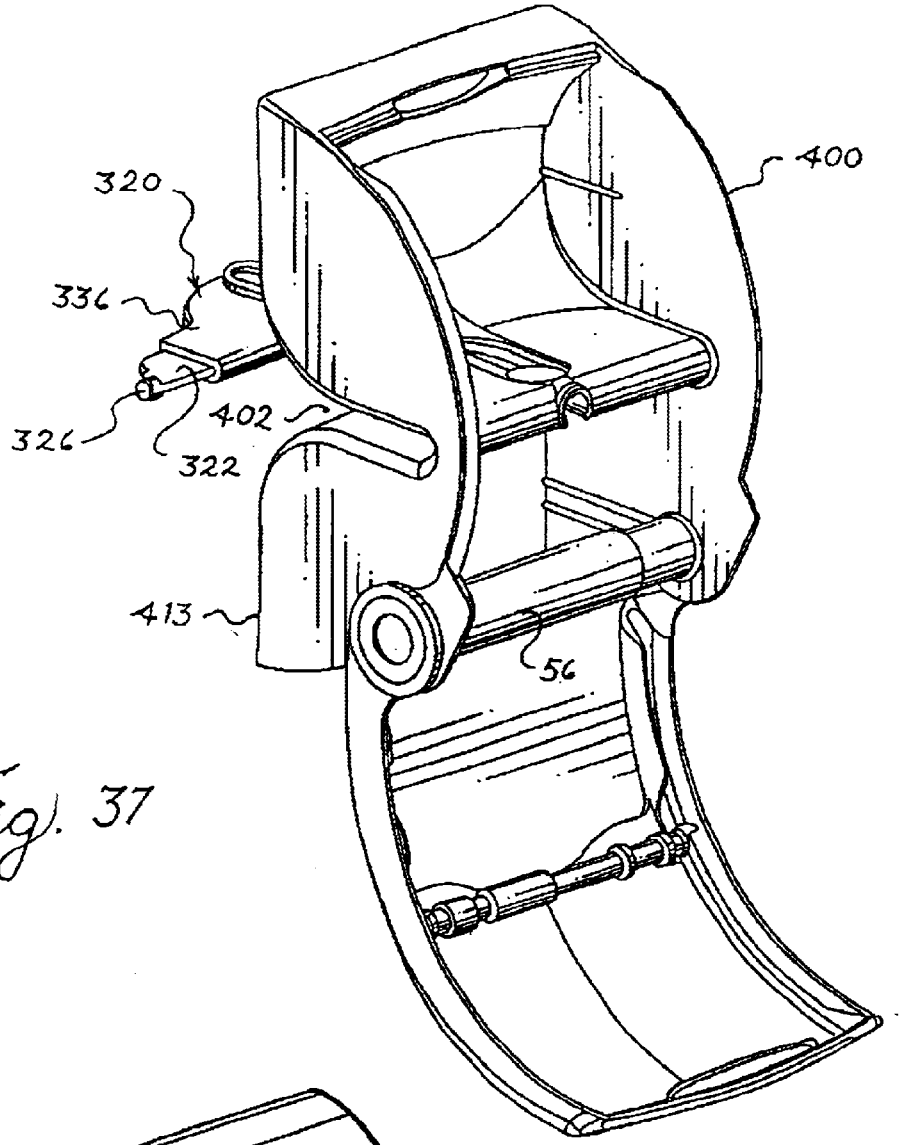
FIG. 37 is a perspective view of a mounting device prior and a dispenser prior to attachment.
Figure 38:
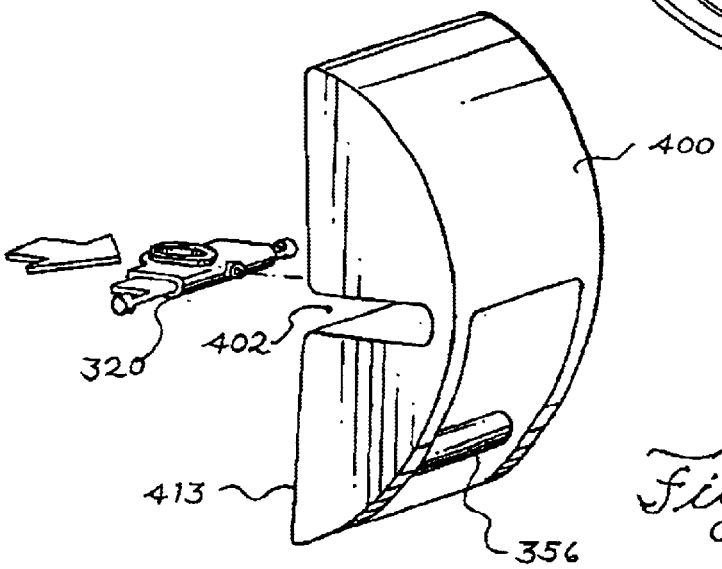
FIG. 38 is a perspective view of a mounting device and a dispenser prior to attachment.

For example, the use of illustrated mounting device 320 which slides into a slot 402 (FIGS. 37 and 38) and is thereby positionable at different locations within the slot permits the mounting device 320 and dispenser 400 to be securely attached at many different relative positions as the fastener 338 engages the dispenser and the dispenser engages the wall at various points along the slot for differently configured fixtures. Typically, the mounting device 320 will be attached to a conventional bathroom tissue fixture and then the dispenser 400 will be secured to the mounting device 320. The illustrated dispenser 400, however, allows access to positioning member 330 when the mounting device is positioned within slot 402 and the mounting device 320 and dispenser 400 may alternatively be attached together before securing the mounting device 320 to the fixture.

In the embodiment illustrated in FIGS. 39 and 40, the mounting device 320 is inserted into slot 402 in an orientation whereby the fastener 338 engages threaded opening 396. By turning the mounting device 320 and inserting the device 320 so that the threaded fastener 338 engages the threaded opening 394, the mounting device 320 and the lateral axis 372 may be located within a more rearward range of relative positions than the range available when the fastener engaged threaded opening 396.

Alternative methods may also be used to enable a mounting device to be attached to a dispenser or other object whereby the lateral axis 372 is located at different relative positions. For example, the dispenser could have a plurality of different openings through which the fastener 338 could be inserted or spacer or adapter components could be placed between the mounting device and the dispenser to selectively alter their relative positions.

Figure 49:
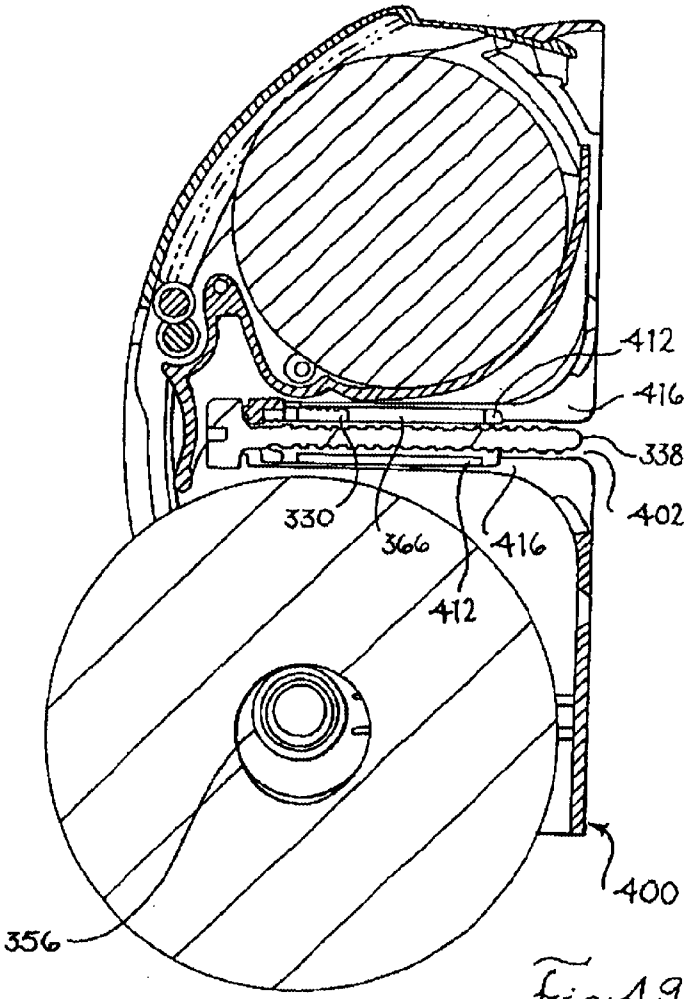
FIG. 49 is a cross sectional view taken along line 49—49 of FIG. 45.
Figure 48:
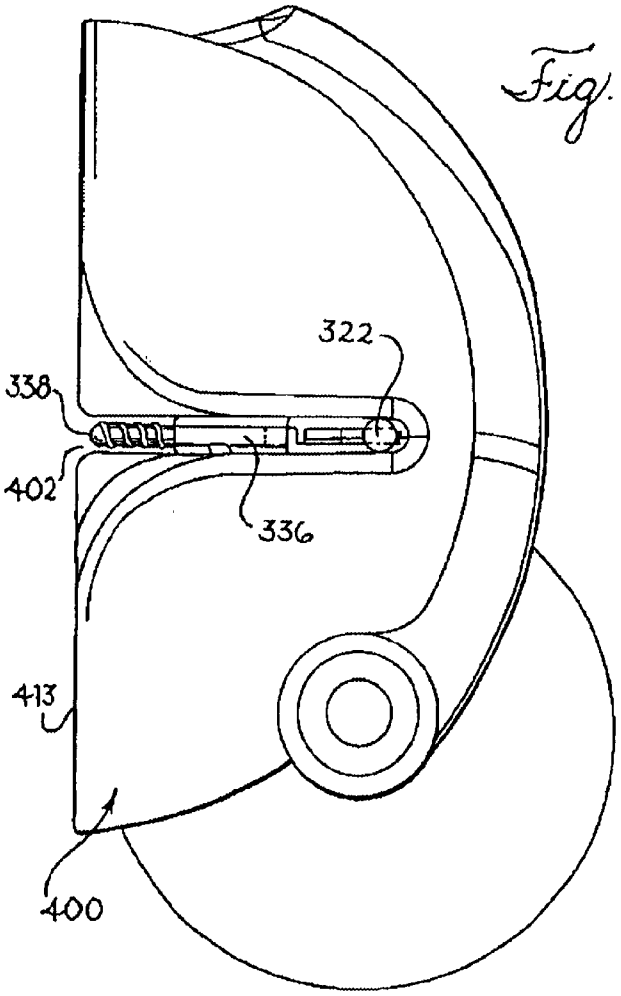
FIG. 48 is a side view of the mounting device and dispenser of FIG. 44.

A projection 412 located on the housing 336 (FIGS. 32 and 33) adjacent the guide slot 66 also facilitates the attachment of the mounting device 320 to the dispenser 400. In the embodiment illustrated in FIGS. 31–40, a racetrack shaped projection 412 is located on the exterior surface of both panel 374 and 376. The projection 412 on panel 376 is partially visible in FIG. 49 and is located directly opposite the projection 412 shown on panel 374.

The projections 412 include two longitudinally extending engagement surfaces 414 on the outer side surface of the projections 412. These outer engagement surfaces 414 engage the interior edge of slots 416 (FIGS. 39 and 49) in the dispenser 400 as the mounting device 320 is attached to the dispenser 400. The engagement of these surfaces facilitates the proper alignment of the mounting device 320 and the dispenser 400. The longitudinally extending engagement surfaces 414 have a longitudinal length which corresponds to the major longitudinal dimension of the housing 336. Thus, the lateral axis 372 is also positioned asymmetrically with respect to the illustrated engagement surfaces 414. This allows the engagement surfaces 414 to facilitate the alignment of the mounting device 320 and the dispenser 400 through the full range of possible attachment positions.

In the alternative mounting device 320*a*, shown in FIGS. 41 and 42, the housing 336*a* and support arms 322*a*, 324*a* have a different configuration. The lateral axis 372 is still defined by the relative movement of distal ends 326*a* and 328*a*. The most significant difference between the mounting device 320 illustrated in FIG. 31 and the mounting device 320*a* illustrated in FIG. 41 is that the mounting device 320*a* of FIG. 41 does not include a linkage 332 or 334 or a longitudinally reciprocable positioning member 330. Instead, a rotatable member such as member 330*a* could be used to engage and move the support arms 322*a*, 324*a* of mounting device 320*a* in manner similar to a rack and pinion gear. The mounting device 320*a* could also include a latching mechanism to prevent the inadvertent movement of the support arms 322*a*, 324*a*.

As can be seen in FIG. 42, the mounting device 320*a* may be secured to a conventional bathroom tissue fixture and a dispenser 400*a* attached thereto in a manner which is similar to that described above for mounting device 320 and dispenser 400.

An alternative mounting device 600 which may also be deployed in a slot 402 is shown in FIGS. 50 and 51. The mounting device 600 includes a threaded bore hole 602 for receiving a fastener and includes two flexible arms 604. Projections 606 located on the distal ends of flexible arms 604 may be inserted into the recesses of a conventional bathroom tissue fixture. FIG. 51 illustrates how the flexible arms 604 are movable to allow the projections 606 to be inserted into the recesses of a conventional bathroom tissue fixture.

Figures 24, 25:
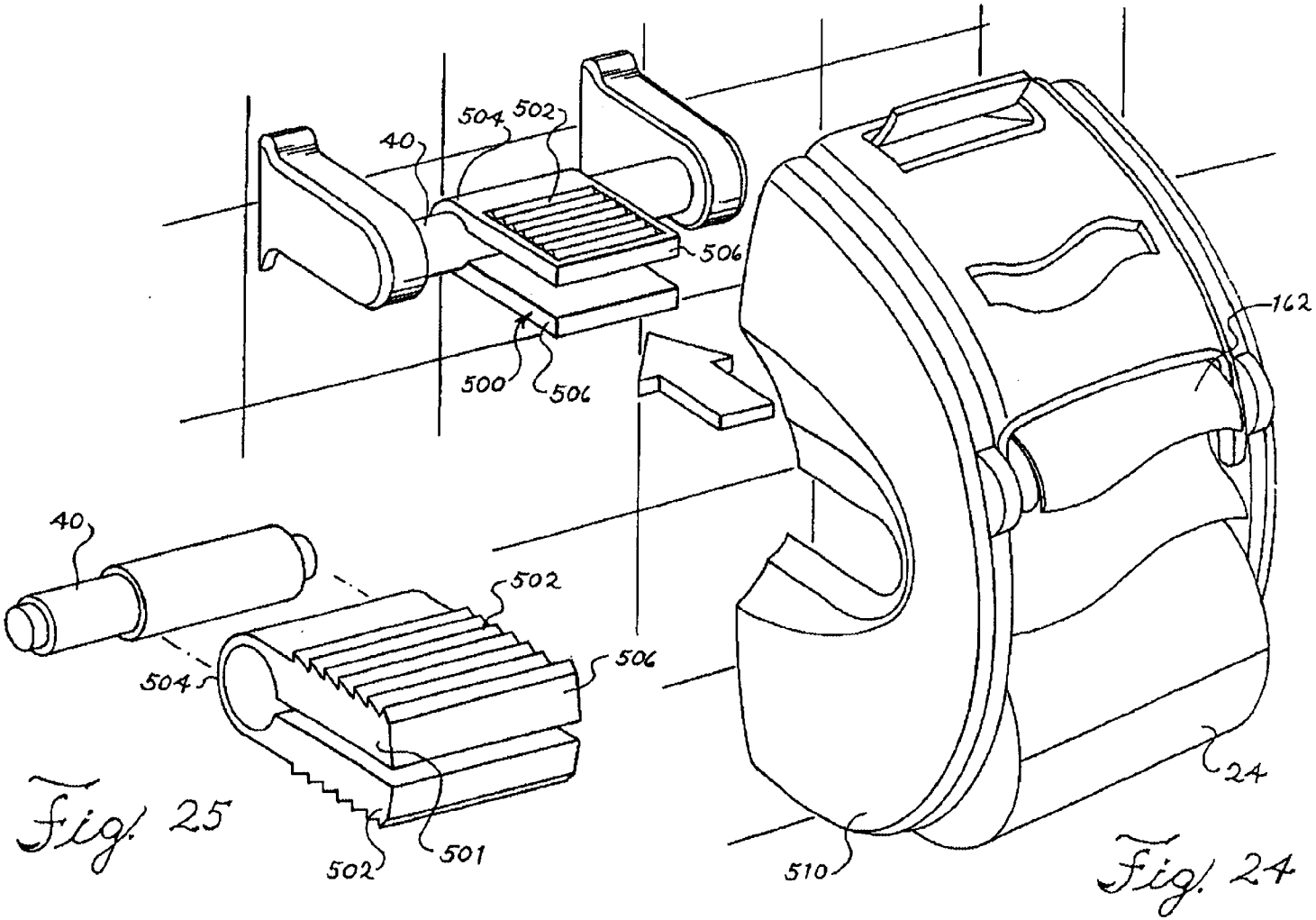
FIG. 24 is a perspective view of an alternative dispenser and mounting device.
FIG. 25 is a perspective view of a roll bar and mounting device.
Figure 26:
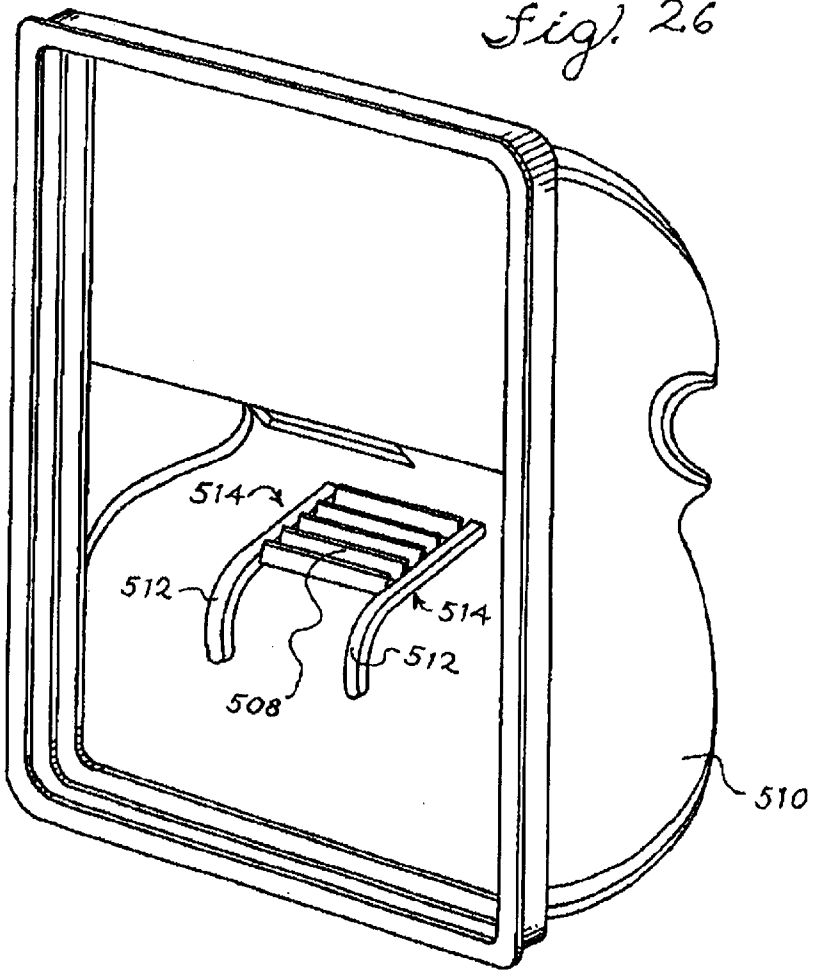
FIG. 26 is a rear perspective view of a dispenser.
Figure 57:
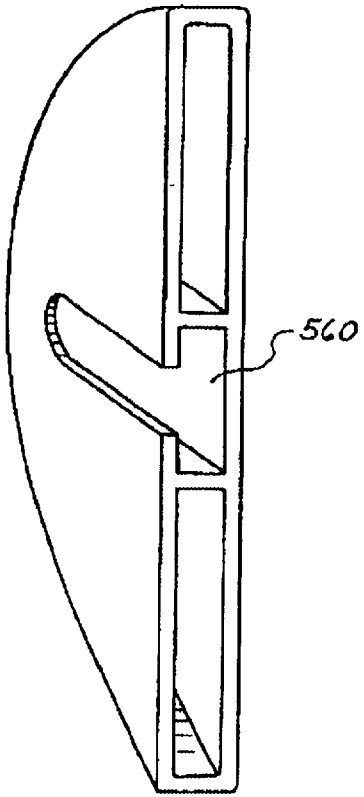
FIG. 57 is a partial perspective view of a dispenser.

An alternative mounting device 500 and dispenser 510 are shown in FIG. 24. The mounting device 500 is substantially U-shaped and is fitted onto a conventional roll bar 40 and may include one or more ratchet teeth 502. A similar mounting device 501 is illustrated in FIG. 25. The mounting devices 500, 501 may include a flexible portion 504 which allows the mounting devices 500, 501 to be hingably openable to receive the roll bar 40 by flexing arms 506 apart from each other. One or both arms 506 may include ratchet teeth 502 for engaging a dispenser 510. As can be seen in FIG. 26, the dispenser 510 may include an engagement mechanism 514 for engaging mounting devices 500, 501. The mechanism 514 includes one or more ratchet teeth 508 for engaging the ratchet teeth 502 of the mounting devices 500, 501. If flexible arms 512 are used with the mechanism 514, the ratchet teeth 508 and 502 may be readily disengaged by biasing the engagement mechanism 514 out of engagement with the mounting device 500, 501. One or more engagement mechanisms 514 may be used to engage mounting devices 500, 501.

Figure 53:
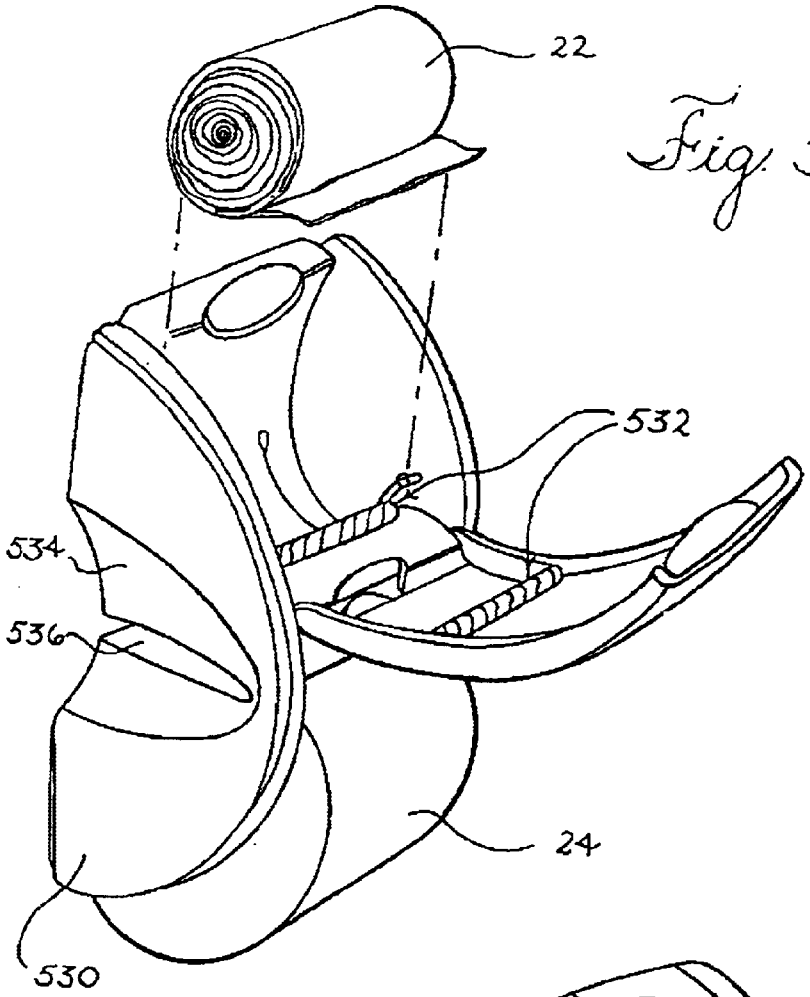
FIG. 53 is a perspective view of a dispenser.
Figure 54:
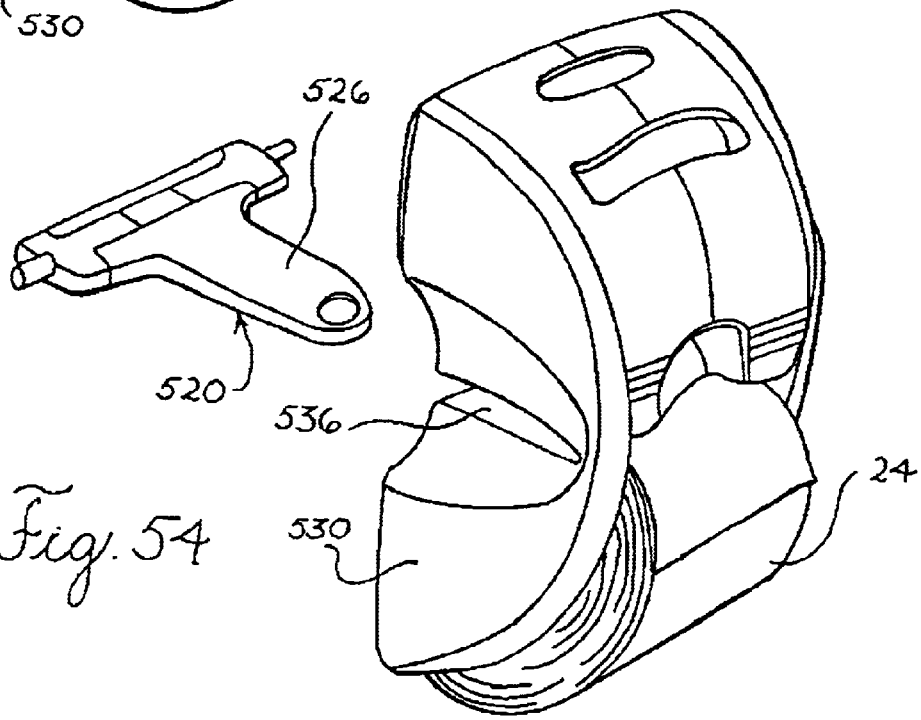
FIG. 54 is a perspective view of the mounting device and dispenser of FIGS. 52 and 53.

A mounting device 520 and dispenser.530 are illustrated in FIGS. 52–54. The mounting device 520 includes a plurality of ratchet teeth 502 and two support arms 522. The support arms 522 include distal elements 524 which are engageable with the opposed recesses of a conventional bathroom tissue fixture. The mounting device 520 is secured to a conventional fixture by manually sliding the support arms 522 outward into engagement with the fixture. Alternatively, the support arms 522 may be resiliently biased outwards by a spring or similar biasing element.

The dispenser 530 includes two dispenser guides 532 between which the premoistened wipes are dispensed. The dispenser guides advantageously include means for preventing the lateral migration of the wipes such as the lands and grooves described above. As can be seen in FIG. 53 the coreless roll 22 of premoistened wipes may be placed directly in the dispenser 530 without using a removable tray. When initially installed, the coreless roll 22 usable with the various dispensers described herein, may advantageously be dispersible in water and have an outer diameter which is approximately 3.25 inches (8.26 cm), an unwound length of approximately 37.5 feet (11.43 m) and approximately 100 individual sheets separated by perforations and having a sheet length of approximately 4.5 inches (11.43 cm).

The dispenser may include a compartment for premoistened wipes which does not including any apertures or openings other than the dispensing opening to minimize the loss of the moisture from the dispenser compartment containing the premoistened wipes.

The mounting device 520 is secured to the dispenser 530 by inserting the tongue 526 into a slot 536 in the dispenser. An engagement mechanism 514 may be used to engage the ratchet teeth 502 located on the mounting device 520. The dispenser 530 may also include a recessed portion 534 which provides space for a conventional bathroom tissue fixture.

Figure 55:
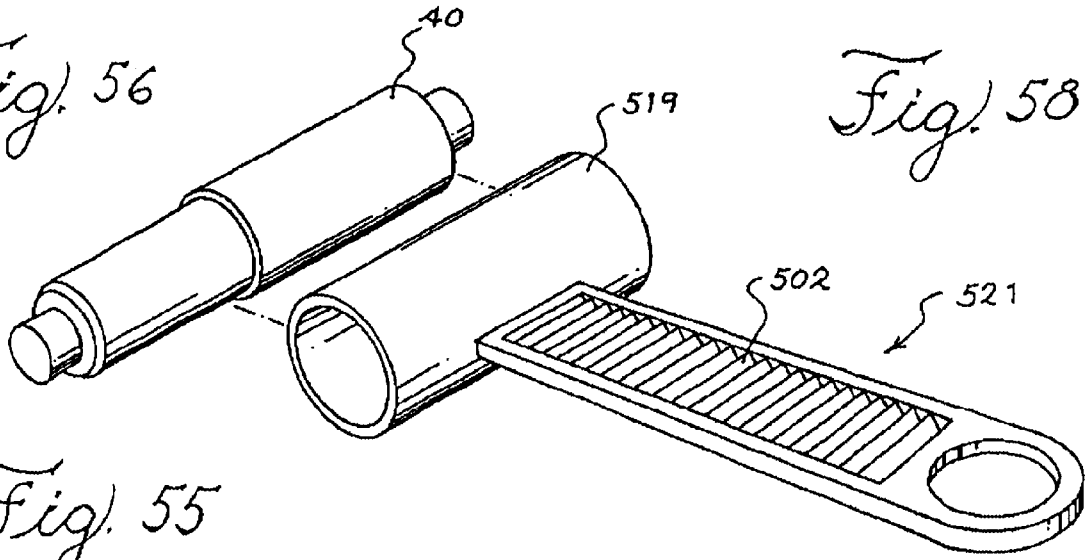
FIG. 55 is a perspective view of a roll bar and mounting device.

Illustrated in FIG. 55 is a mounting device 521 which is similar to mounting device 520 but alternatively employs a cylindrical sleeve 521 which is slipped over a conventional roll bar 40 to thereby secure the mounting device 521 to a conventional bathroom tissue fixture.

Figure 58:
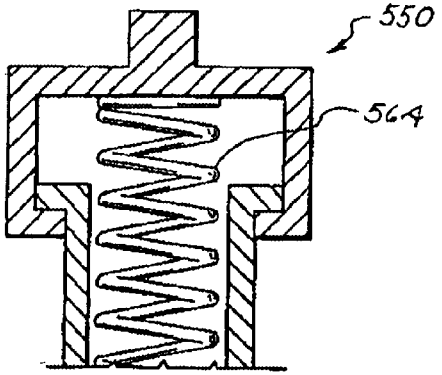
FIG. 58 is a partial cross sectional view of the mounting device of FIG. 56.
Figure 56:
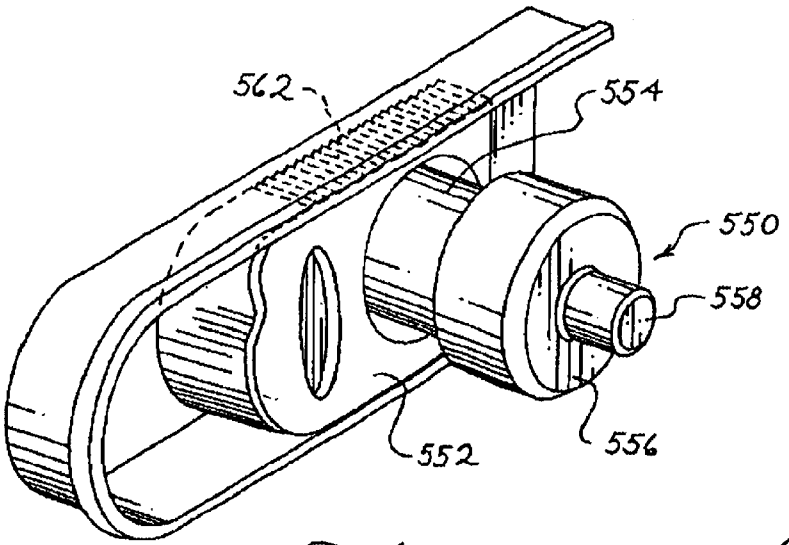
FIG. 56 is a perspective view of a mounting device and a portion of a dispenser.

A mounting device 550 is illustrated in FIGS. 56 and 58. Two mounting devices 550 may be inserted into slots 560 located on opposite sides of the dispenser for engagement with the opposing recesses of a conventional bathroom tissue fixture. The mounting device 550 may include a main body 552 which is inserted into the slot 560, a stem member 554 extending outward therefrom and a cap member 556 for engaging the recess of a conventional fixture. The cap member 556 may also include a projection 558 for insertion into the recess of a conventional fixture. The cap member 556 may be advantageously biased outward with a spring 564 as shown in FIG. 58. The mounting device 550 may include ratchet teeth 562 for engaging the mounting device 550 with the slot 560.

While this invention has been described in detail, it will be readily apparent to a person of ordinary skill in the art that various changes and modifications can be made without departing from the spirit and general principles of the invention. All of such changes and modifications are contemplated as being within the scope of the present invention as defined by the subjoined claims. Furthermore, this application is intended to cover such departures from the present disclosure as come within known or customary practice in the art.

What is claimed is:

1. A dispenser for premoistened wipes and dry tissue mountable on a conventional bathroom tissue fixture, said dispenser comprising:

a housing having at least one substantially horizontal engagement surface and defining a first compartment and a second compartment;

said first compartment defining a substantially enclosed interior space, the premoistened wipes being positionable within said interior space;

said second compartment including a support bar for the dry tissue; and a mounting device supportingly engaging said engagement surface, said mounting device having a first support and a second support, said first and second supports defining a lateral axis and being projectable outwardly from opposite sides of said dispenser for engagement with the fixture, said mounting device being adjustably attachable to said housing whereby said mounting device engages a selective portion of said engagement surface and said lateral axis is selectively positionable relative to said dispenser housing.

2. The dispenser of claim 1 wherein said first compartment includes a first horizontally extending panel, and said second compartment includes a second horizontally extending panel, said first and second horizontally extending panels relatively disposed in spaced and substantially parallel positions and defining a slot therebetween for slidably receiving said mounting device, said engagement surface disposed on one of said horizontally extending panels, said slot having first and second openings on opposite lateral sides of said dispenser through which said first and second supports project outwardly.

3. The dispenser of claim 2 wherein said dispenser further comprises a forward lip defining said slot, said forward lip having an aperture, and a fastener inserted through said aperture and securing said mounting device in a selected position.

4. The dispenser of claim 2 wherein said first and second openings extend to a rear surface of said dispenser and said slot further includes a rear opening extending along said rear surface and connecting said first and second openings.

5. The dispenser of claim 1 wherein said mounting device is laterally and slidably engaged with said housing whereby said mounting device is slidable in a direction substantially perpendicular to said lateral axis.

6. The dispenser of claim 1 wherein said mounting device is slidably positionable between said first and second compartments and said mounting device laterally engages a panel defining a portion of one of said compartments whereby said mounting device is slidable in a direction substantially perpendicular to said lateral axis.

7. The dispenser of claim 1 wherein said first compartment includes a first horizontally extending panel and said second compartment includes a second horizontally extending panel, said first and second horizontally extending panels relatively disposed in spaced and substantially parallel positions and defining a slot therebetween, said mounting device being slidably positioned between said first and second horizontally extending panels and laterally engaging each of said horizontally extending panels whereby said mounting device is slidable in a direction substantially perpendicular to said lateral axis.

8. The dispenser of claim 7 wherein said mounting device comprises a first projection for engaging a first recess in said first horizontally extending panel and a second projection for engaging a second recess in said second horizontally extending panel.

9. The dispenser of claim 1 further comprising a tray having a support surface for the premoistened wipes, said tray being removably positionable in said interior space.

10. The dispenser of claim 1 wherein said first compartment includes a cover having open and closed positions.

11. A dispenser for premoistened wipes and dry tissue mountable on a conventional bathroom tissue fixture, said dispenser comprising:

a housing having a first compartment and a second compartment;

said first compartment comprising a first plurality of connected panels, said first plurality of panels including a first horizontally extending panel, the premoistened wipes being positionable within said first compartment;

said second compartment comprising a second plurality of connected panels, said second plurality of panels including a second horizontally extending panel, said second compartment including a support bar for the dry tissue, said support bar attachable to at least one of said second plurality of panels; and a mounting device adjustably positionable between said first horizontally extending panel and said second horizontally extending panel, said mounting device having a first support and a second support, said first and second supports defining a lateral axis and being projectable outwardly from opposite sides of said dispenser for engagement with the fixture.

12. The dispenser of claim 11 wherein said first and second horizontally extending panels define a slot therebetween for slidably receiving said mounting device, said slot having first and second openings on opposite lateral sides of said dispenser through which said first and second supports project outwardly.

13. The dispenser of claim 12 wherein said dispenser further comprises a forward lip defining said slot, said forward lip having an aperture, and a fastener inserted through said aperture and securing said mounting device in a selected position.

14. The dispenser of claim 11 wherein said mounting device is slidably positionable between said first and second horizontally extending panels and said mounting device laterally engages at least one of said horizontally extending panels whereby said mounting device is slidable in a direction substantially perpendicular to said lateral axis.

15. The dispenser of claim 11 wherein said mounting device is slidably positionable between said first and second horizontally extending panels and said mounting device laterally engages each of said horizontally extending panels whereby said mounting device is slidable in a direction substantially perpendicular to said lateral axis.

16. The dispenser of claim 15 wherein said mounting device comprises a first projection for engaging a first recess in said first horizontally extending panel and a second projection for engaging a second recess in said second horizontally extending panel.

17. A dispenser for premoistened wipes and dry tissue mountable on a conventional bathroom tissue fixture, said dispenser comprising:

first compartment having a cover and defining a substantially enclosed interior space;

a tray having a support surface for the premoistened wipes and removably positioned within said interior space;

a support bar for the dry tissue, said support bar attachable to said dispenser; and a mounting device having first and second supports, said first and second supports defining a lateral axis and being projectable outwardly from opposite sides of said dispenser for engagement with the fixture, said mounting device being adjustably positionable relative to said first compartment.

18. The dispenser of claim 17 wherein said mounting device is slidably positioned in a horizontally extending slot.

19. The dispenser of claim 17 wherein said tray includes at least one laterally extending roller for supporting the premoistened wipes.

20. The dispenser of claim 17 wherein said tray includes a plurality of ribs having support surfaces, the premoistened wipes being positionable on said support surfaces.

21. A dispenser for premoistened wipes and dry tissue, said dispenser comprising:

a housing having a first compartment and a second compartment;

said first compartment including a cover panel cooperatively engageable with a first plurality of panels whereby said cover and first plurality of panels define a substantially enclosed interior space when said cover panel is in a closed position, the premoistened wipes being positionable within said interior space;

said second compartment including a pair of side panels, said side panels including a pair of oppositely disposed openings for supporting a roll bar; and a pair of pivot arms attached to said cover panel, said pivot arms pivotally connected to said dispenser whereby said cover panel is moveable between said closed position and an open position, said pivot arms having a pivotal axis aligned with said oppositely disposed openings.

22. The dispenser of claim 21 wherein said pivot arms are attached to said second compartment side panels.

23. A dispenser for a moist wipe comprising:

a frame;

a means for attaching the frame to a wall;

a means for holding a moist wipe within the frame;

the means for holding the moist wipe further comprising:

a tray;

the tray being positionable within the frame;

the tray comprising a pair of sidewall, a front wall and a back wall;

the sidewalls and back wall having a top edge;

a cover; and, the cover being openable with respect to the frame.

24. A dispenser for a moist wipe comprising:

a frame;

a roll of moist wipes;

an interior chamber within the frame;

the interior chamber holding the roll of moist wipes;

a cover;

the cover having an open position and a closed position with respect to the frame;

the dispenser having an opening when the cover is in the closed position;

at least a portion of the moist wipe protruding from the interior chamber through the opening.

* * * * *